US008795074B2

(12) United States Patent
Arakawa

(10) Patent No.: US 8,795,074 B2
(45) Date of Patent: Aug. 5, 2014

(54) GAME MACHINE, DISPLAY CONTROL METHOD, AND DISPLAY CONTROL PROGRAM

(75) Inventor: Kenichi Arakawa, Aichi (JP)

(73) Assignee: Kyoraku Industrial Co., Ltd., Nagoya-shi, Aichi (JP)

( * ) Notice: Subject to any disclaimer, the term of this patent is extended or adjusted under 35 U.S.C. 154(b) by 528 days.

(21) Appl. No.: 12/986,336

(22) Filed: Jan. 7, 2011

(65) Prior Publication Data

US 2012/0028704 A1 Feb. 2, 2012

(30) Foreign Application Priority Data

Jul. 30, 2010 (JP) ..... 2010-173124

(51) Int. Cl.
*A63F 9/24* (2006.01)
*G07F 17/32* (2006.01)
*G07F 17/38* (2006.01)

(52) U.S. Cl.
CPC ..... *G07F 17/3211* (2013.01); *G07F 17/3223* (2013.01); *G07F 17/3267* (2013.01); *G07F 17/38* (2013.01)
USPC ..... 463/31

(58) Field of Classification Search
USPC ..... 463/31, 32, 28, 30
See application file for complete search history.

(56) References Cited

U.S. PATENT DOCUMENTS

| | | | | |
|---|---|---|---|---|
| 5,836,819 | A * | 11/1998 | Ugawa | 463/30 |
| 2003/0032479 | A1* | 2/2003 | LeMay et al. | 463/32 |
| 2003/0228902 | A1* | 12/2003 | Walker et al. | 463/25 |
| 2006/0065729 | A1 | 3/2006 | Miyairi | |

FOREIGN PATENT DOCUMENTS

| | | | |
|---|---|---|---|
| JP | 2003-199912 | A | 7/2003 |
| JP | 2005081011 | A | 3/2005 |
| JP | 2006-099636 | A | 4/2006 |
| JP | 2010026905 | A | 2/2010 |

OTHER PUBLICATIONS

Notice of Reasons for Rejection, dated Sep. 28, 2012, issued for JP Patent Application No. 2010-173124 (w/English Translation).

* cited by examiner

*Primary Examiner* — David L Lewis
*Assistant Examiner* — Eric M Thomas
(74) *Attorney, Agent, or Firm* — Schiff Hardin LLP

(57) ABSTRACT

A game machine, a display control method, and a display control program that make it possible to play a game focusing on an object whose sound output is being performed, even when a plurality of three-dimensional objects are arranged in a three-dimensional virtual space, are provided. Among three-dimensional objects in the three-dimensional virtual space, a three-dimensional object whose sound information is being output is mapped with a virtual camera. A performance image including the mapped three-dimensional object is drawn. The drawn performance image is displayed and controlled on a display device.

6 Claims, 26 Drawing Sheets

FIG.20

| 2001 PERFORMANCE STATE | 2002 TARGET OBJECT | 2003 SOUND OUTPUT STATE INFORMATION |
|---|---|---|
| PERFORMANCE STATE 1 | CHARACTER OBJECT A | CHANNEL 1 |
| | CHARACTER OBJECT B | CHANNEL 2 |
| PERFORMANCE STATE 2 | CHARACTER OBJECT A | CHANNEL 2 |
| | CHARACTER OBJECT D | CHANNEL 1 |
| | CHARACTER OBJECT C | — (NOT SPECIFIED) |
| ... | ... | ... |

*FIG.23*

| 2301 PERFORMANCE STATE | 2302 TARGET OBJECT FOR CAMERA | 2303 CAMERA MOTION INFORMATION |
|---|---|---|
| PERFORMANCE STATE A | CHARACTER OBJECT A | CAMERA MOTION INFORMATION 1 |
| | CHARACTER OBJECT B | |
| PERFORMANCE STATE B | CHARACTER OBJECT A | CAMERA MOTION INFORMATION 2 |
| | CHARACTER OBJECT C | |
| | CHARACTER OBJECT D | |
| ... | ... | ... |

GAME MACHINE, DISPLAY CONTROL METHOD, AND DISPLAY CONTROL PROGRAM

BACKGROUND OF THE INVENTION

1. Field of the Invention

The present invention relates to a game machine, a display control method, and a display control program.

2. Description of the Prior Art

With the recent improvement of computer performance, there have been disclosed a lot of technologies for creating a three-dimensional virtual space just like a real space by using computer graphics.

Technologies to display a performance image on a display screen of game machines typically a pachinco machine have been disclosed. The performance image is obtained by mapping a three-dimensional object arranged in a three-dimensional virtual space from the viewpoint of a virtual camera placed in a predetermined position in the virtual space.

For example, Japanese Patent Application Laid-Open No. 2006-099636 discloses a technology for updating and displaying a video picture (image) from the viewpoint of the virtual camera in real time when the viewpoint of the virtual camera or the position of the three-dimensional object is moved.

Japanese Patent Application Laid-Open No. 2003-199912 discloses a technology for displaying an identifying pattern and a reliability pattern as if rotating sterically with the background when changing the line of sight of the virtual camera.

With the above-mentioned technologies, it is sometimes difficult to identify which object outputs sound when a plurality of three-dimensional objects arranged in the virtual space are imaged by the virtual camera and outputs sound.

SUMMARY OF THE INVENTION

It is thus an object of the present invention to provide a game machine, a display control method, and a display control program that make it possible to play a game focusing on a three-dimensional object outputting sound, even when a plurality of three-dimensional objects are arranged in a three-dimensional virtual space.

To achieve the foregoing object, the invention according to claim 1 includes: a display device for displaying a performance image drawn by mapping a performance object arranged in a three-dimensional virtual space from a virtual camera which serves as a viewpoint in the three-dimensional virtual space; a sound output device for outputting sound information in a performance using the performance object; camera direction changing means for changing a direction of the virtual camera toward a performance object of which the sound information is output from the sound output device in a game using a game medium; mapping means for mapping the performance object from a camera position of the virtual camera after changing the direction of the camera by the camera direction changing means; drawing means for drawing a performance image that includes the performance object mapped by the mapping means; and display control means for displaying and controlling the performance image drawn by the drawing means on the display device.

The invention according to claim 2 is the invention according to claim 1, wherein: the mapping means includes camera switching means for switching to another virtual camera different from the virtual camera with which the performance object of which the sound information is output from the sound output device is mapped; and the performance object is mapped from the viewpoint of the virtual camera after being switched by the camera switching means.

The invention according to claim 3 is the invention according to claim 1 or 2, wherein: the mapping means maps only the performance object of which the sound output is performed by the sound output device based on the sound information; and the drawing means draws the performance image that includes no performance object other than the performance object mapped by the mapping means.

The invention according to claim 4 is the invention according to any one of claims 1 to 3, further including: storing means for storing state information on a sound output state of each performance object with respect to a performance time of the performance object; and sound output performance object identifying means for identifying a performance object of which the sound information is output, based on the state information stored by the storing means. The mapping means maps the performance object that is identified by the sound output performance object identifying means.

The invention according to claim 5 is the invention according to claim 4, wherein if a plurality of performance objects are identified by the sound output performance object identifying means, the mapping means maps so as to cover the performance objects.

The invention according to claim 6 includes: mapping a performance object of which sound information is output from a sound output device with a virtual camera, the sound output device outputting sound information in a performance using a performance object arranged in a three-dimensional virtual space in a game using a game medium; drawing a performance image that includes the mapped performance object; and displaying and controlling the drawn performance image on a display device.

The invention according to claim 7 causes a computer to function as: mapping means for mapping a performance object of which sound information is output from a sound output device with a virtual camera, the sound output device outputting sound information in a performance using a performance object arranged in a three-dimensional virtual space in a game using a game medium; drawing means for drawing a performance image that includes the performance object mapped by the mapping means; and display control means for displaying and controlling the performance image drawn by the drawing means on a display device.

The present invention has the effect that enables to play a game focusing on an object outputting sound, even when a plurality of three-dimensional objects are arranged in a three-dimensional virtual space.

BRIEF DESCRIPTION OF THE DRAWINGS

FIG. 20 is a diagram showing an example of performance state information;

FIG. 23 is a diagram showing an example of the performance state information;

DETAILED DESCRIPTION OF THE PREFERRED EMBODIMENT

Hereinafter, an embodiment of the game machine, the display control method, and the display control program according to the present invention will be described in detail with reference to the accompanying drawings.

Embodiment

Figure 1:
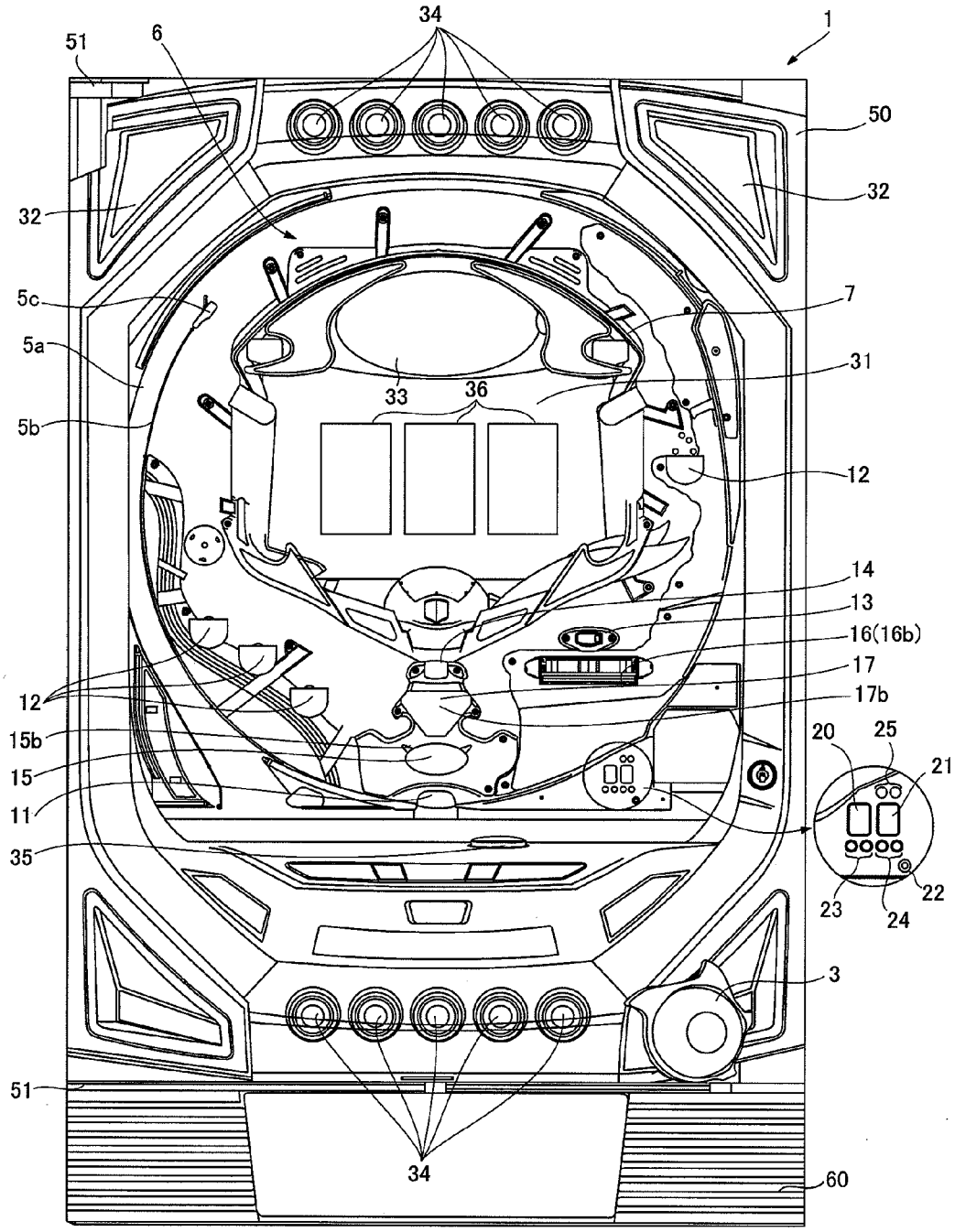
FIG. 1 is a front view of a game machine which is configured through the application of the game machine, the display control method, and the display control program according to an embodiment of the present invention.
Figure 2:
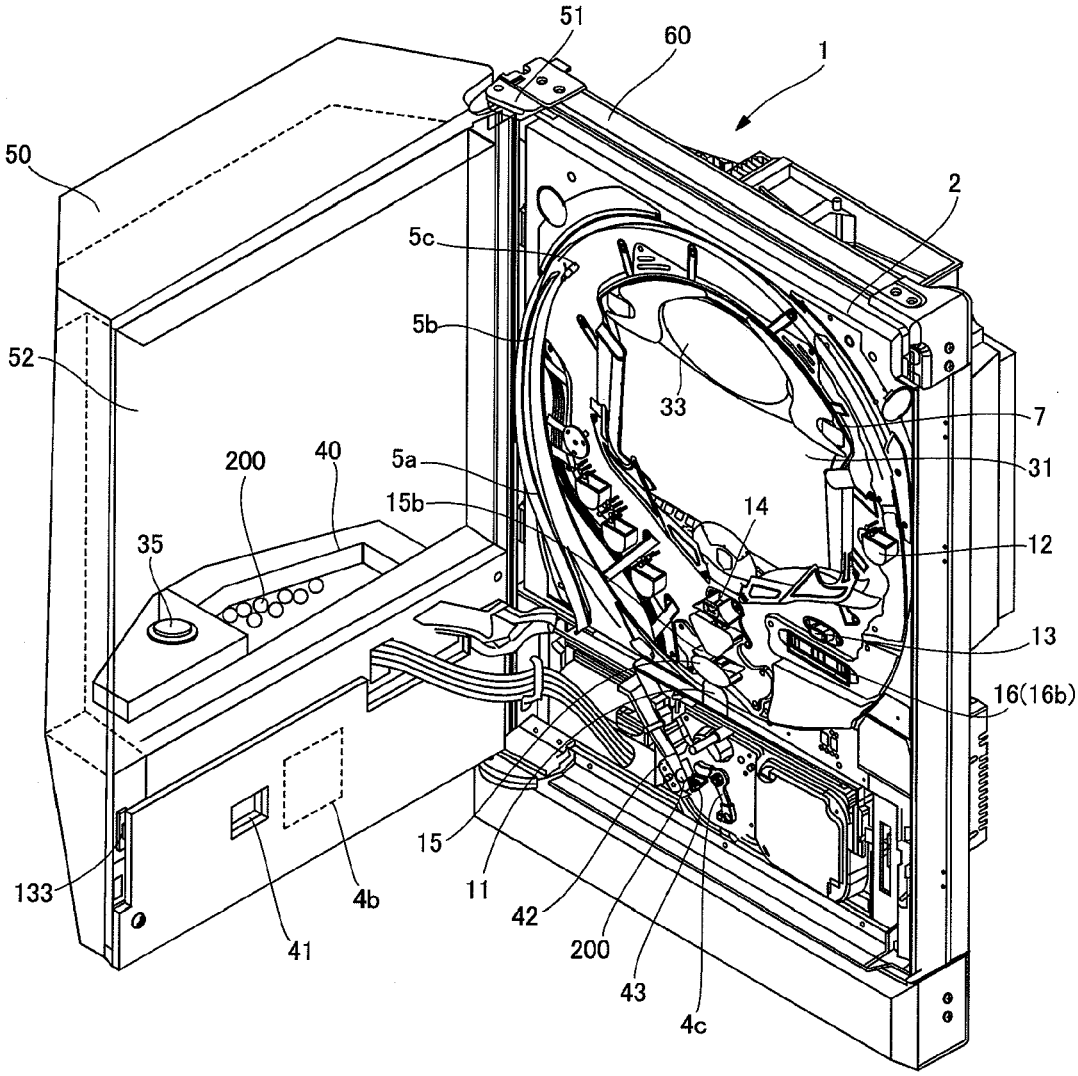
FIG. 2 is a perspective view of the game machine which is configured through the application of the game machine, the display control method, and the display control program according to the embodiment of the present invention, with a glass frame arranged on the front opened.
Figure 3:
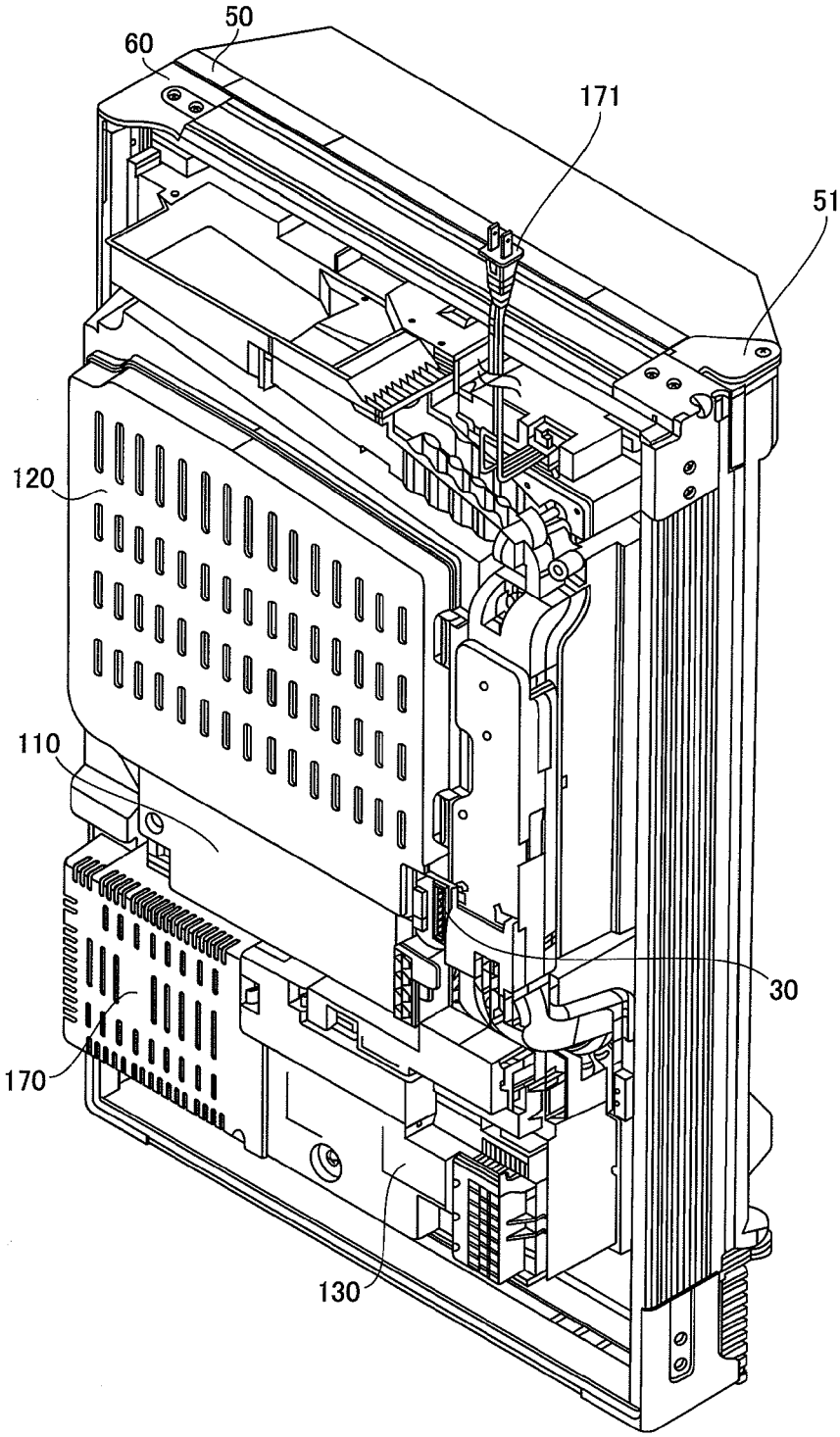
FIG. 3 is a perspective view of the back side of the game machine which is configured through the application of the game machine, the display control method, and the display control program according to the embodiment of the present invention.

FIG. 1 is an example of an apparatus configuration diagram showing a game machine that is configured through the application of the game machine, the display control method, and the display control program according to the embodiment of the present invention. FIG. 2 is a perspective view of the game machine 1 according to the present invention with a glass frame opened. FIG. 3 is a perspective view of the back side of one game machine 1.

The game machine 1 includes an outer frame 60 which is attached to island facilities in a game parlor, and a glass frame 50 which is rotatably supported by the outer frame 60 (see FIGS. 1 and 2). The outer frame 60 is equipped with a game panel 2 which has a game field 6 for game balls to cascade down. The glass frame 50 is provided with: an operating handle 3 which is rotationally operated to shoot game balls toward the game field 6; sound output devices 32 which are composed of speakers; performance illumination devices 34 which include a plurality of lamps; and a performance button 35 which is intended to change a performance mode by a depressing operation.

The glass frame 50 also has a tray 40 for storing a plurality of game balls. The tray 40 is inclined downward so that game balls flow down toward the operating handle 3 (see FIG. 2). An inlet port for accepting game balls is formed at the end of inclination of the tray 40. Game balls taken into the inlet port are driven by a ball feed solenoid 4*b* and sent to a ball feed opening 41 formed in the back side of the glass frame 50 one by one.

The game ball sent to the ball feed opening 41 is guided through a shoot rail 42, which is inclined toward a flipper member 4*c*, to the end of inclination of the shoot rail 42. A stopper 43 for stopping and retaining a game ball is arranged above the end of inclination of the shoot rail 42. A single game ball sent from the ball feed opening 41 is stopped and retained at the end of inclination of the shoot rail 42 (see FIG. 2).

When the player rotates the operating handle 3, a shoot volume 3*b* directly connected to the operating handle 3 is also rotated. The shoot volume 3*b* adjusts the shooting strength of the game ball, and the flipper member 4*c* which is directly connected to a shooting solenoid 4*a* is rotated by the adjusted shooting strength. When the flipper member 4*c* is rotated, the flipper member 4*c* shoots off the game ball stored at the end of inclination of the shoot rail 42, and the game ball is shot into the game field 6.

The game ball shot from the shoot rail 42 as described above ascends between rails 5*a* and 5*b*, passes a backflow prevention piece 5*c* to reach the game field 6, and then cascades down within the game field 6. Here, the game ball falls in an unpredictable manner because of a plurality of pins and pinwheels arranged on the game field 6.

A plurality of general prize holes 12 are formed in the game field 6. The general prize holes 12 are provided with respective general prize hole detection switches 12*a*. When the general prize hole detection switches 12*a* detect the entry of a game ball, predetermined winning balls (for example, ten game balls) are dispensed.

A first start hole 14, a second start hole 15, and a second bonus prize hole 17 are formed in the lower central area of the game field 6. The first start hole 14 and the second start hole 15 constitute start areas which game balls can enter. The second bonus prize hole 17 also allows the entry of game balls.

The second start hole 15 has a pair of movable pieces 15*b*. The second start hole 15 is motion-controlled between a first mode where the pair of movable pieces 15*b* are maintained in a closed state and a second mode where the pair of movable pieces 15*b* are in an open state. When the second start hole 15 is controlled to the first mode, the winning members of the second bonus prize hole 17 arranged directly above the second start hole 15 function as an obstacle to the acceptance of game balls.

On the other hand, when the second start hole 15 is controlled to the second mode, the pair of movable pieces 15*b* function as a tray, facilitating the entry of game balls into the second start hole 15. That is, if the second start hole 15 is in the first mode, there is no chance for game balls to enter. If the second start hole 15 is in the second mode, there is a higher chance for game balls to enter.

Here, the first start hole 14 is provided with a first start hole detection switch 14*a* which detects the entry of a game ball. The second start hole 15 is provided with a second start hole detection switch 15*a* which detects the entry of a game ball. When the first start hole detection switch 14*a* or the second start hole detection switch 15*a* detects the entry of a game ball, a special symbol judgment random number value and the like are acquired to perform drawing for the right to play a jackpot game to be described later (hereinafter, referred to as "jackpot drawing").

Predetermined winning balls (for example, three game balls) are also dispensed when the first start hole detection switch 14*a* or the second start hole detection switch 15*a* detects the entry of a game ball.

The second bonus prize hole 17 includes an opening formed in the game panel 2. The second bonus prize hole 17 has on its lower part a second bonus prize hole opening and closing door 17*b* which can be protruded from the game panel side toward a glass plate 52. The second bonus prize hole opening and closing door 17*b* is motion-controlled between an open state of being protruded from the game panel side and a closed state of sinking into the game panel side.

When protruded from the game panel side, the second bonus prize hole opening and closing door 17*b* functions as a tray that guides game balls into the second bonus prize hole 17, so that game balls can enter the second bonus prize hole 17. The second bonus prize hole 17 is provided with a second bonus prize hole detection switch 17*a*. When the second bonus prize hole detection switch 17*a* detects the entry of a game ball, predetermined winning balls (for example, 15 game balls) are dispensed.

A normal symbol gate 13 which constitutes a normal area where game balls can pass and a first bonus prize hole 16 which game balls can enter are formed in the right area of the game field 6.

Such a configuration prevents game balls from passing or entering the normal symbol gate 13 or the first bonus prize hole 16 unless the operating handle 3 is largely rotated to launch the game balls by strong force.

In particular, with such a configuration, game balls cascading down the left area of the game field 6 will not pass the normal symbol gate 13 even in a Jitan (quick) game state to be described later. Since the pair of movable pieces 15*b* on the second start hole 15 will not enter the open state, it is difficult for game balls to enter the second start hole 15.

The normal symbol gate 13 is provided with a gate detection switch 13*a* which detects the passage of a game ball. When the gate detection switch 13*a* detects the passage of a game ball, a normal symbol judgment random number value is acquired to perform "normal symbol drawing" to be described later.

The first bonus prize hole 16 is usually maintained in the closed state by a first bonus prize hole opening and closing door 16*b*, thereby precluding the entry of game balls. When a special game to be described later is started, the first bonus prize hole opening and closing door 16*b* is opened. The first bonus prize hole opening and closing door 16*b* functions as a tray that guides game balls into the first bonus prize hole 16, so that game balls can enter the first bonus prize hole 16. The first bonus prize hole 16 is provided with a first bonus prize hole detection switch 16*a*. When the first bonus prize hole detection switch 16*a* detects the entry of a game ball, predetermined winning balls (for example, 15 game balls) are dispensed.

An out hole 11 is formed in the bottom area of the game field 6. The out hole 11 is intended to drain game balls that fail to enter any of the general prize holes 12, the first start hole 14, the second start hole 15, the first bonus prize hole 16, and the second bonus prize hole 17.

A decoration member 7 which has an influence on the cascading of game balls is provided in the center of the game field 6. A liquid crystal display (LCD) 31 is arranged generally in the center area of the decoration member 7. A belt-shaped performance drive device 33 is arranged above the liquid crystal display 31.

The liquid crystal display 31 displays images on standby when no game is being played, or displays images according to the progress of a game. In particular, the liquid crystal display 31 displays three performance symbols 36 for notifying the result of jackpot drawing to be described later. A certain combination of performance symbols 36 (such as 777) remains to be displayed to notify of hitting a jackpot as the result of jackpot drawing.

More specifically, when a game ball enters the first start hole 14 or the second start hole 15, each of the three performance symbols 36 is scrolled. After a lapse of predetermined time, each of them stopped scrolling to display the performance symbols 36. While the display of the performance symbols 36 is changing, a variety of images, characters, and the like are displayed in order to give the player a sense of high anticipation of hitting a jackpot.

The performance drive device 33 is intended to give the player a sense of anticipation by means of its operating mode. For example, the performance drive device 33 makes an operation such that the belt moves downward, or a rotating member rotates in the belt center. Such modes of operation of the performance drive device 33 are intended to give the player various feelings of anticipation.

In addition to the various types of performance devices described above, the sound output devices 32 enables audio performances by outputting the characters' voices, background music (BGM), sound effects (SE), and the like. The performance illumination devices 34 change the direction of light projection and the color of each lamp for illumination-based performances.

The performance button 35 is enabled, for example, only when a message to operate the performance button 35 appears on the liquid crystal display 31. The performance button 35 is provided with a performance button detection switch 35*a*. When the performance button detection switch 35*a* detects the player's operation, an additional performance is executed according to the operation.

A first special symbol display device 20, a second special symbol display device 21, a normal symbol display device 22, a first special symbol reservation indicator 23, a second special symbol reservation indicator 24, and a normal symbol reservation indicator 25 are arranged on the lower right of the game field 6.

The first special symbol display device 20 is intended to notify of the result of jackpot drawing that is performed when a game ball enters the first start hole 14. The first special symbol display device 20 is composed of a 7-segment LED. More specifically, there are provided a plurality of special symbols corresponding to results of jackpot drawing. The first special symbol display device 20 displays a special symbol corresponding to a result of jackpot drawing, thereby notifying the player of the result of drawing. For example, "7" appears when a jackpot is hit, and "–" appears when not. Such "7" and "–" displayed are the special symbols. The special symbols are not immediately displayed, but are stopped and displayed after showing variations for a predetermined time.

Here, the "jackpot drawing" refers to the processing of acquiring a special symbol judgment random number value and judging whether the special symbol judgment random number value acquired is the one corresponding to a "jackpot" or the one corresponding to a "small jackpot" when a game ball enters the first start hole 14 or the second start hole 15. The result of jackpot drawing is not immediately notified to the player. The first special symbol display device 20 displays the special symbol with variations such as blinking, and after a lapse of a predetermined variation time, the special symbol corresponding to the result of jackpot drawing is displayed without variations to notify the player of the result of drawing.

The second special symbol display device 21 is intended to notify of the result of jackpot drawing that is performed when a game ball enters the second start hole 15. The display mode is the same as that of the special symbols on the first special symbol display device 20.

In the present embodiment, the "jackpot" refers to winning the right to play a jackpot game in the jackpot drawing that is performed when a game ball enters the first start hole 14 or the second start hole 15. In the "jackpot game", a total of 15 round games are played where the first bonus prize hole 16 or the second bonus prize hole 17 is opened up. The maximum open time of the first bonus prize hole 16 or the second bonus prize hole 17 in each round game is set to a predetermined time. A single round game ends if a predetermined number of game balls (for example, nine) enter the first bonus prize hole 16 or the second bonus prize hole 17 during that period.

That is, in the "jackpot game", game balls enter the first bonus prize hole 16 or the second bonus prize hole 17 and the player can win balls according to the entering balls.

The normal symbol display device 22 is intended to notify the result of normal symbol drawing which is performed when a game ball passes the normal symbol gate 13. As will be detailed later, the normal symbol display device 22 is lit when hitting a win in the normal symbol drawing. The second start hole 15 is then controlled to the second mode for a predetermined time.

Here, the "normal symbol drawing" refers to the processing of acquiring a normal symbol judgment random number value and determining whether the normal symbol judgment random number value acquired is one corresponding to "winning" when a game ball passes the normal symbol gate 13. Again, the result of normal symbol drawing is not notified immediately after a game ball passes the normal symbol gate 13. The normal symbol display device 22 displays the normal symbol with variations such as blinking, and after a lapse of a predetermined variation time, the normal symbol corresponding to the result of normal symbol drawing is displayed without variations to notify the player of the result of drawing.

The right for jackpot drawing is reserved under a certain condition when a game ball entering the first start hole 14 or the second start hole 15 unable to perform jackpot drawing immediately, such as during a special symbol is being displayed with variations and during a special game as described later.

More specifically, the special symbol judgment random number value that is acquired when a game ball enters the first start hole 14 is stored as a first reservation. The special symbol judgment random number value that is acquired when a game ball enters the second start hole 15 is stored as a second reservation.

The maximum number of each reservation is set to four. The numbers of reservations are displayed on the first special symbol reservation indicator 23 and the second special symbol reservation indicator 24, respectively.

If there is one first reservation, the left LED of the first special symbol reservation indicator 23 is lit. If there are two first reservations, the two LEDs of the first special symbol reservation indicator 23 are lit. If there are three first reservations, the left LED of the first special symbol reservation indicator 23 is blinked and the right LED is lit. If there are four first reservations, the two LEDs of the first special symbol reservation indicator 23 are blinked.

The second special symbol reservation indicator 24 displays the number of second reservations as mentioned in the first special symbol reservation.

The maximum number of normal symbol reservations is also set to four. The number of reservations is displayed on the normal symbol reservation indicator 25 in the same way as with the first special symbol reservation indicator 23 and the second special symbol reservation indicator 24.

The glass frame 50 supports the glass plate 52 in front (player side) of the game panel 2. The game field 6 is visibly covered with the glass plate 52. The glass plate 52 is detachably fixed to the glass frame 50.

The glass frame 50 is coupled to the outer frame 60 via hinge mechanism parts 51 on either one of the lateral sides (for example, the left side when the game machine 1 is viewed from the front). The glass frame 50 is configured so that the other lateral side (for example, the right side when the game machine 1 is viewed from the front) can be rotated about the hinge mechanism parts 51 in an opening direction from the outer frame 60. The glass frame 50 covers the game panel 2 along with the glass plate 52, and can be rotated about the hinge mechanism parts 51 in a door-like manner, thereby the interior of the outer frame 60 including the game panel 2 can be exposed.

The other end of the glass frame 50 is provided with a lock mechanism which fixes the other end of the glass frame 50 to the outer frame 60. The fixing of the lock mechanism can be released by a dedicated key. The glass frame 50 is provided with a door open switch 133 which detects whether the glass frame 50 is opened from the outer frame 60.

As shown in FIG. 3, a main control board 110, a performance control board 120, a dispensing control board 130, a power supply board 170, a game information output terminal strip 30, and the like are arranged on the backside of the game machine 1. The power supply board 170 has a power plug 171 for supplying power to the game machine 1, and has a not-shown power supply switch.

Figure 4:
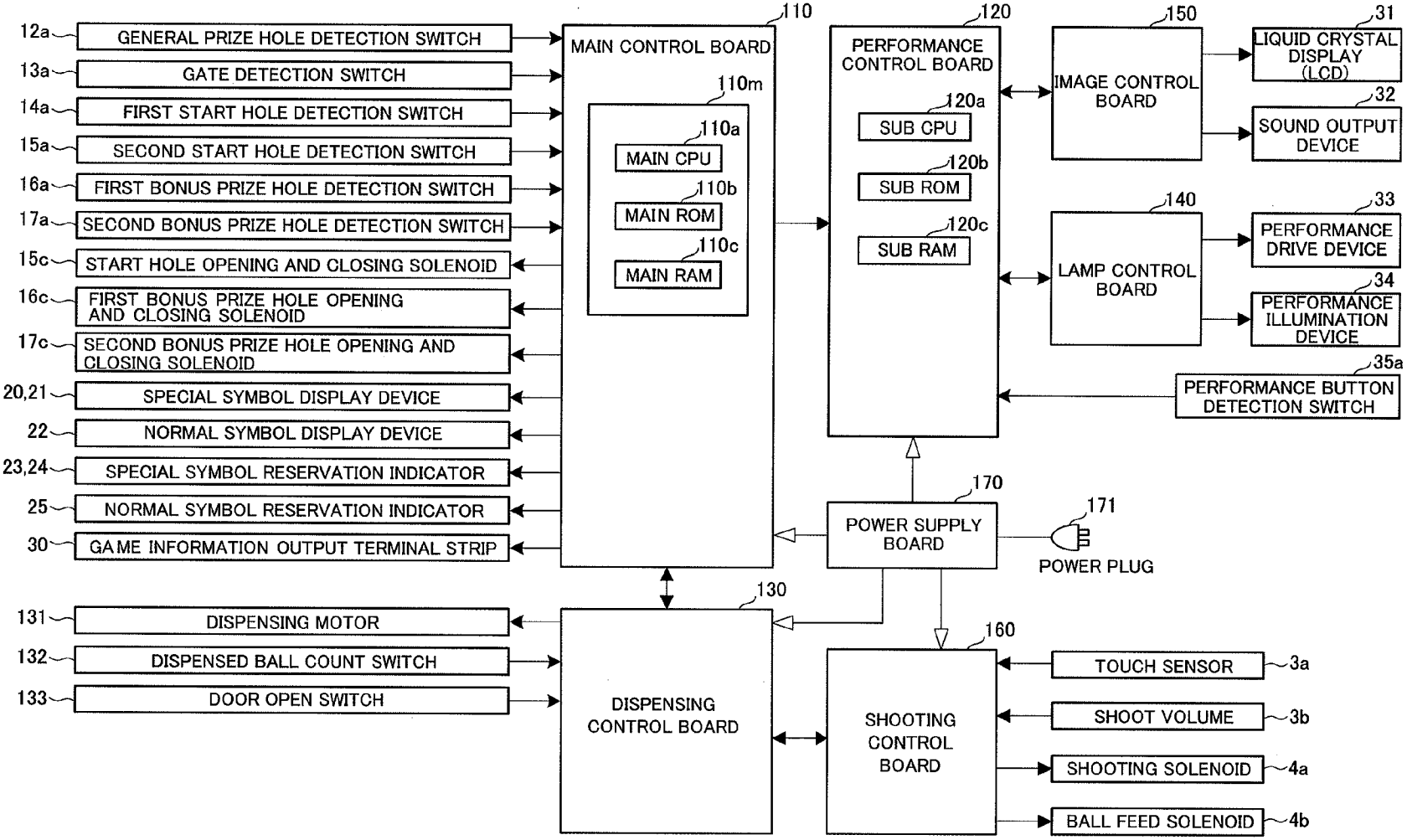
FIG. 4 is a block diagram showing the detailed configuration of the entire game machine which is configured through the application of the game machine, the display control method, and the display control program according to the embodiment of the present invention.

Next, control means for controlling the game progress will be described with reference to a block diagram of the entire game machine 1 of FIG. 4.

The main control board 110 is main control means for controlling basic operations of the game. The main control board 110 drives the first special symbol display device 20, a first bonus prize hole opening and closing solenoid 16*c*, and the like for game control, when various types of detection signals are input from the first start hole detection switch 14*a* and the like.

The main control board 110 includes at least a one-chip microcomputer 110*m* which is composed of a main CPU 110*a*, a main ROM 110*b*, and a main RAM 110*c*, and input ports and output ports (not shown) for main control.

The input ports for main control are connected to: the dispensing control board 130; the general prize hole detection switches 12*a* which detect the entry of a game ball into the general prize holes 12; the gate detection switch 13*a* which detects the entry of a game ball into the normal symbol gate 13; the first start hole detection switch 14*a* which detects the entry of a game ball into the first start hole 14; the second start hole detection switch 15*a* which detects the entry of a game ball into the second start hole 15; the first bonus prize hole detection switch 16*a* which detects the entry of a game ball into the first bonus prize hole 16; and the second bonus prize hole detection switch 17*a* which detects the entry of a game ball into the second bonus prize hole 17. Various signals are input to the main control board 110 through the input ports for main control.

The output ports for main control are connected to: the dispensing control board 130; a start hole opening and closing solenoid 15*c* which operates to open and close the pair of movable pieces 15*b* on the second start hole 15; the first bonus prize hole opening and closing solenoid 16*c* which operates the first bonus prize hole opening and closing door 16*b*; a second bonus prize hole opening and closing solenoid 17*c* which operates the second bonus prize hole opening and closing door 17*b*; the first special symbol display device 20 and the second special symbol display device 21 which display special symbols; the normal symbol display device 22 which displays a normal symbol; the first special symbol reservation indicator 23 and the second special symbol reservation indicator 24 which indicate the numbers of balls reserved for special symbols; the normal symbol reservation indicator 25 which indicates the number of balls reserved for normal symbols; and the game information output terminal strip 30 which outputs external information signals. Various signals are output through the output ports for main control.

The main CPU 110*a* reads a program stored in the main ROM 110*b* and performs arithmetic processing based on the input signals from the detection switches and timers. The main CPU 110*a* also controls the devices and indicators directly, and transmits commands to other boards depending on the result of arithmetic processing.

The main CPU 110*a* can perform jackpot drawing for a reserved ball prior to the drawing processing corresponding to the reserved ball, thereby acquiring (pre-reading) the result of drawing beforehand. Here, the main CPU 110*a* transmits the pre-acquired result of drawing to the image control board 150 through the performance control board 120.

The main ROM 110*b* of the main control board 110 stores programs for game control, and data and tables necessary for making various game determinations. For example, the main ROM 110*b* stores: a jackpot judgment table referenced for jackpot drawing; a winning judgment table referenced for normal symbol drawing; a symbol determination table to determine the special symbols to remain to be displayed; a jackpot game end time setting data table to determine the game state after the end of a jackpot; a special electrical gadget start mode determination table to determine the opening and closing conditions of the bonus prize hole opening and closing doors; a bonus prize hole open mode table; a variation pattern determination table to determine the variation pattern of the special symbols; and so on.

The tables mentioned above are just a few examples of characteristic tables among the tables according to the present embodiments. A lot of other not-shown tables and programs are provided for game progresses.

The main RAM 110*c* of the main control board 110 functions as a data work area in the arithmetic processing of the main CPU 110*a*, and includes a plurality of storing areas.

For example, the main RAM 110*c* has a normal symbol reserved number (G) storing area, a normal symbol reservation storing area, a normal symbol data storing area, a first special symbol reserved number (U1) storing area, a second special symbol reserved number (U2) storing area, a first special symbol random number value storing area, a second special symbol random number value storing area, a round game number (R) storing area, an open number (K) storing area, a bonus prize hole entering ball number (C) storing area, a game state storing area (a high probability game flag storing area and a quick game flag storing area), a high probability game number (X) counter, a quick number (J) counter, a game state buffer, a stop symbol data storing area, a performance transmission data storage area, a special symbol time counter, a special game timer counter, and various other timer counters. The storing areas mentioned above are just a few examples, and a lot of other storing areas are provided.

The game information output terminal strip 30 is a substrate for outputting the external information signals generated by the main control board 110 to a hall computer or the like of the game parlor. The game information output terminal strip 30 is wired and connected to the main control board 110, and has connectors for connecting to the hall computer or the like in the game parlor, which transmits and receives external information.

The power supply board 170 includes a capacitor-based backup power supply, and supplies a power supply voltage to the game machine 1. The power supply board 170 monitors the power supply voltage supplied to the game machine 1, and if the power supply voltage falls to a predetermined value and below, outputs an electricity disconnection detection signal to the main control board 110. More specifically, the electricity disconnection detection signal of high level activates the main CPU 110*a*. The electricity disconnection detection signal of low level deactivates the main CPU 110*a*. The backup power supply is not limited to the capacitor. For example, a battery may be used. Both of the capacitor and the battery may be used.

The performance control board 120 mainly controls performances during a game, on standby, and the like. The performance control board 120 includes a sub CPU 120*a*, a sub ROM 120*b*, and a sub RAM 120*c*. The performance control board 120 is connected with the main control board 110 to allow one-way communication from the main control board 110 to the performance control board 120. The sub CPU 120*a* reads a program stored in the sub ROM 120*b* and performs arithmetic processing based on a command transmitted from the main control board 110, or an input signal from the performance button detection switch 35*a* or a timer. Based on the processing, the sub CPU 120*a* transmits corresponding data to the lamp control board 140 or the image control board 150. The data includes information on three-dimensional objects to be arranged in a three-dimensional virtual space using a three-dimensional coordinate system and also includes information regarding performances using a virtual camera which serves as the viewpoint to view the three-dimensional virtual space.

The sub RAM 120*c* functions as a data work area in the arithmetic processing of the sub CPU 120*a*.

For example, the sub CPU 120*a* of the performance control board 120 receives a variation pattern specification command which specifies the mode of variation of the special symbols from the main control board 110. Then, the sub CPU 120*a* analyzes the content of the variation pattern specification command received, and generates data allowing the liquid crystal display 31, the sound output devices 32, the performance drive device 33, and the performance illumination devices 34 to execute predetermined performances. The sub CPU 120*a* transmits the above-mentioned data to the image control board 150 and the lamp control board 140.

The sub ROM 120*b* of the performance control board 120 stores programs for performance control, and data and tables necessary for making various game determinations.

For example, the sub ROM 120*b* stores a performance pattern determination table for determining a performance pattern based on the variation pattern specification command received from the main control board, a performance symbol determination table for determining the combination of performance images 36 to remain to be displayed, and the like.

The tables mentioned above are just a few examples of characteristic tables among the tables according to the present embodiment. A lot of other not-shown tables and programs are provided for game progress.

The sub RAM 120*c* of the performance control board 120 functions as a data work area in the arithmetic processing of the sub CPU 120*a*, and includes a plurality of storing areas.

The sub RAM 120*c* has a game state storing area, a performance mode storing area, a performance pattern storing area, a performance symbol storing area, and the like. The storing areas mentioned above are just a few examples, and a lot of other storing areas are provided.

The dispensing control board 130 performs a dispensing control on game balls. The dispensing control board 130 includes a one-chip microcomputer that is composed of a not-shown dispensing CPU, dispensing ROM, and dispensing RAM. The dispensing control board 130 is connected to the main control board 110 so as to be capable of two-way communications. The dispensing CPU reads a program stored in the dispensing ROM and performs arithmetic processing based on input signals from a dispensed ball count detection switch 132 which detects whether game balls are dispensed, the door open switch 133, and timers. Based on the processing, the dispensing CPU transmits corresponding data to the main control board 110.

A dispensing motor 131 of a dispensing device for dispensing a predetermined number of game balls from the game ball reservoir is connected to the output side of the dispensing control board 130. Based on a dispensing number specification command transmitted from the main control board 110, the dispensing CPU reads a predetermined program from the dispensing ROM, performs arithmetic processing, and controls the dispensing motor 131 of the dispensing device to dispense predetermined game balls.

Here, the dispensing RAM functions as a data work area in the arithmetic processing of the dispensing CPU.

The lamp control board 140 performs a lighting control on the performance illumination devices 34 arranged on the game panel 2, and performs a drive control on motors for changing the directions of light projection. The lamp control board 140 also performs an energization control on drive sources such as solenoids and motors that actuate the performance drive device 33. The lamp control board 140 is connected to the performance control board 120, and performs the foregoing controls based on various commands transmitted from the performance control board 120.

The image control board 150 is connected to the liquid crystal display 31 and the sound output devices 32. Based on various commands transmitted from the performance control board 120, the image control board 150 controls an image display on the liquid crystal display 31 and a sound output on the sound output devices 32.

The image control board 150 will be detailed below with reference to a block diagram of the image control board of FIG. 5.

The image display control will now be described with reference to the block diagram of the image control board 150 of FIG. 5.

The image control board 150 includes a host CPU 150*a*, a host RAM 150*b*, a host ROM 150*c*, a CG ROM 151, a quartz oscillator 152, a VRAM 153, and a VDP (Video Display Processor) 2000, which are intended for the image display control on the liquid crystal display 31, and a sound control circuit 3000.

The host CPU 150*a* having a performance control unit 200 instructs the VDP 2000 to display image data stored in the CG ROM 151 on the liquid crystal display 31 based on a performance pattern specification command received from the performance control board 120. Such an instruction is given by setting data into control registers of the VDP 2000 and outputting a display list including a group of drawing control commands, as well as outputting "camera motion information" which is generated by the performance control unit 200.

On receiving a V blank interrupt signal or a drawing end signal from the VDP 2000, the host CPU 150*a* performs interrupt processing if necessary.

Based on the performance pattern specification command received from the performance control board 120, the host CPU 150*a* also instructs the sound control circuit 3000 to make the sound output devices 32 output predetermined sound data.

The host RAM 150*b* that is built in the host CPU 150*a* functions as a data work area in the arithmetic processing of the host CPU 150*a*, and temporarily stores data that is read from the host ROM 150*c*.

The host ROM 150*c* that is made of a mask ROM stores programs for the control processing of the host CPU 150*a*, a display list generation program for generating a display list, an animation pattern for displaying an animated performance pattern, animation information, and so on.

The animation pattern is referenced when displaying the animated performance pattern. The animation pattern stores a combination of pieces of animation scene information to be included in the performance pattern, the order of display of the pieces of animation scene information, and the like. The animation scene information stores such information as wait frame (display time), target data (sprite ID number, transmission source address, and the like), parameters (sprite display position, transmission destination address, and the like), and the method of drawing.

The CG ROM 151 that is constituted by a flash memory, EEPROM, EPROM, mask ROM, or the like stores compressed image data (sprite, movie) and so on which includes pixel information on a predetermined area of pixels (for example, 32×32 pixels). The pixel information is composed of color number information that specifies a color number for each pixel, and an α value that indicates the transparency of the image.

The CG ROM 151 also stores space information on a three-dimensional virtual space using a three-dimensional coordinate system, and object information (object shape, color, and the like) on three-dimensional objects to be arranged in the three-dimensional virtual space.

The CG ROM 151 further stores uncompressed palette data which associates color number information for specifying color numbers with display color information for actual color display.

The CG ROM 151 may store partly compressed but not entirely compressed image data. Various known compression methods such as MPEG-4 may be used for the movie compression.

The quartz oscillator 152 outputs a pulsed signal to the VDP 2000. The pulsed signal is frequency-divided to generate a system clock for the VDP 2000 to use for control, synchronizing signals intended for synchronization with the liquid crystal display 31, and the like.

The VRAM 153 is made of an SRAM which is capable of writing and reading image data at high speed.

The VRAM 153 includes: a display list storing area 153*a* which temporarily stores a display list that is output from the host CPU 150*a*; a decompression storing area 153*b* which stores image data that is decompressed by a decompression circuit; and a first frame buffer 153*c* and a second frame buffer 153*d* which are intended to draw or display an image. The VRAM 153 also stores the palette data.

The two frame buffers are switched alternately between a "drawing frame buffer" and a "display frame buffer" each time on starting to draw.

The VDP 2000, so-called image processor, reads image data from either one of the frame buffers (display frame buffer) based on an instruction from the host CPU 150*a*, and generates a video signal (such as RGB signal) and outputs the same to the liquid crystal display based on the read image data.

The VDP 2000 includes not-shown control registers, a CG bus I/F, a CPU I/F, a clock generation circuit, a decompression circuit, a drawing circuit, a display circuit, and a memory controller, which are connected by a bus.

The control registers are registers allowing the VDP 2000 to control drawing and display. The drawing control and display control are performed by writing and reading data to/from the control registers. The host CPU 150*a* can write and read data to/from the control registers through the CPU I/F.

The control registers are composed of six types of registers, including: a system control register for making basic settings necessary for the operation of the VDP 2000; a data transfer register for making a setting necessary for data transfer; a drawing register for making a setting for drawing control; a bus interface register for making a setting necessary for bus access; a decompression register for making a setting necessary for the decompression of a compressed image; and a display register for making a setting for display control.

The CG bus I/F is an interface circuit for communication with the CG ROM 151. The image data from the CG ROM 151 is input to the VDP 2000 through the CG bus I/F.

The CPU I/F is an interface circuit for communication with the host CPU 150*a*. The host CPU 150*a* outputs a display list to the VDP 2000, accesses the control registers, and receives various interrupt signals from the VDP 2000 through the CPU I/F.

The data transfer circuit performs data transfer between various types of devices.

Specifically, the data transfer circuit performs data transfer between the host CUP 150*a* and the VRAM 153, data transfer between the CG ROM 151 and the VRAM 153, and mutual data transfer between various storing areas of the VRAM 153 (including the frame buffers).

The clock generation circuit inputs the pulsed signal from the quartz oscillator 152, and generates the system clock which determines the arithmetic processing speed of the VDP 2000. The clock generation circuit also generates a synchronizing signal generating clock, and outputs synchronizing signals to the liquid crystal display 31 through the display circuit.

The decompression circuit is a circuit for decompressing the compressed image data in the CG ROM 151. The decompression circuit stores the decompressed image data into the expansion storing area 153*b*.

The drawing circuit is a circuit for performing a sequence control based on a display list which is composed of a group of drawing control commands.

The display circuit is a circuit that generates a video signal, or an RGB signal (analog signal) which shows color data on the image, from the image data (digital signal) stored in the "display frame buffer" of the VRAM 153. The display circuit outputs the generated video signal (RGB signal) to the liquid crystal display 31. The display circuit also outputs the synchronizing signals intended for synchronization with the liquid crystal display 31 (such as a vertical synchronizing signal and a horizontal synchronizing signal) to the liquid crystal display 31.

In the present embodiment, the analog RGB signal converted from the digital signal is output to the liquid crystal display 31 as the video signal. However, the digital signal may be output as the video signal.

The memory controller controls to switch between the "drawing frame buffer" and the "display frame buffer" when an instruction for frame buffer switching is given from the host CPU 150*a*.

The sound control circuit 3000 includes a sound ROM which stores a lot of sound data. The sound control circuit reads a predetermined program based on a command transmitted from the performance control board 120, and controls sound output of the sound output devices 32.

Figure 6:
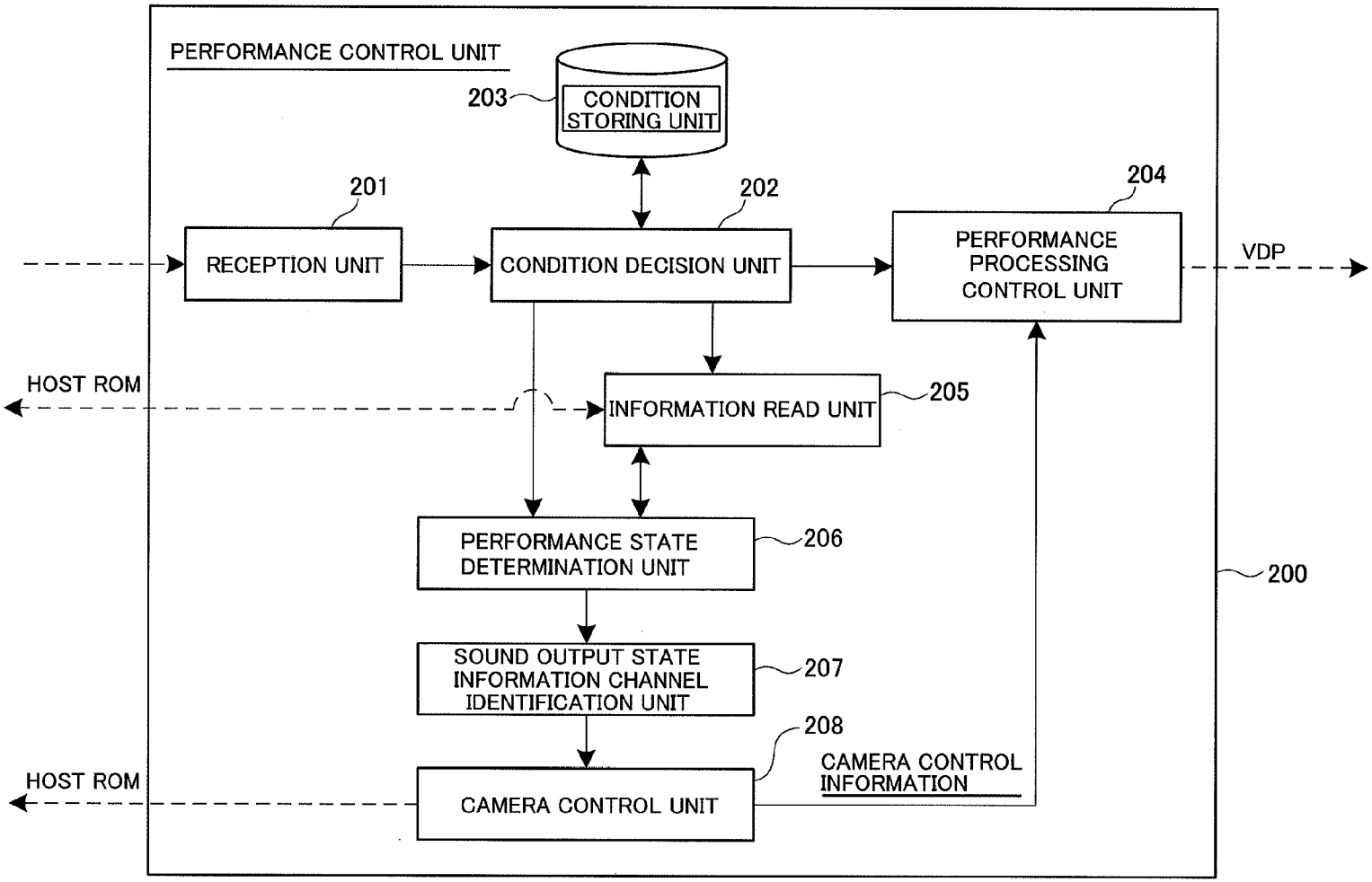
FIG. 6 is a block diagram showing the detailed configuration of a performance control unit which is configured through the application of the game machine, the display control method, and the display control program according to the embodiment of the present invention.

FIG. 6 is a block diagram showing the detailed configuration of the performance control unit which is configured through the application of the game machine, the display control method, and the display control program according to the embodiment of the present invention.

Figure 5:
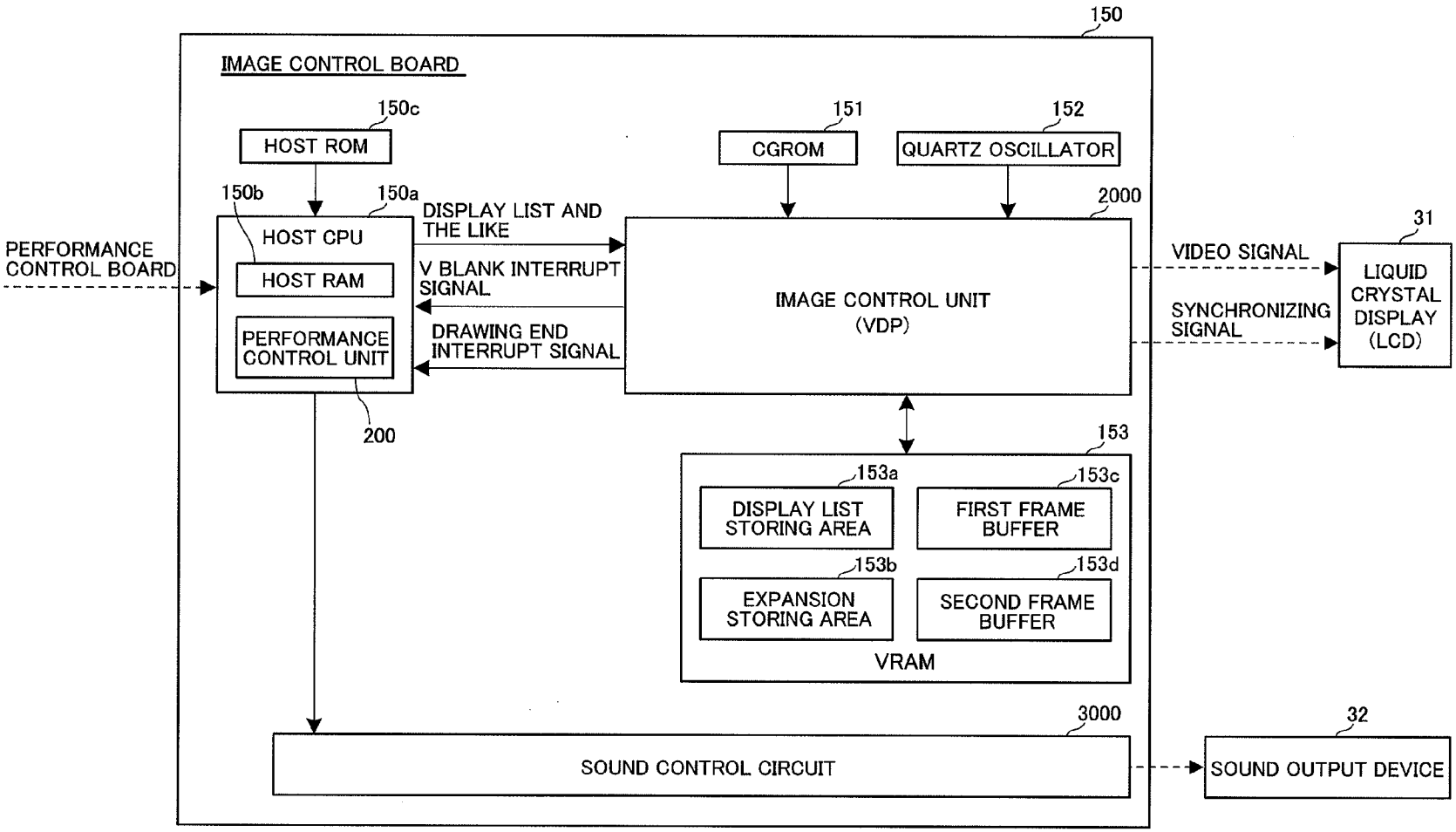
FIG. 5 is a block diagram showing the detailed configuration of an image control board which constitutes the block diagram of the entire game machine shown in FIG. 4.

In FIG. 6, the performance control unit 200 constitutes part of the host CPU 150*a* of the image control board 150 shown in FIG. 5. The performance control unit 200 includes a receiving unit 201, a condition decision unit 202, a condition storing unit 203, a performance processing control unit 204, an information read unit 205, a performance state determination unit 206, a sound output state information channel identification unit 207, and a camera control unit 208.

The receiving unit 201 of the performance control unit 200 which constitutes the host CPU 150*a* of the image control board 150 receives data for executing a predetermined performance (performance pattern specification command) from the performance control board 120 which controls performances during a game, on standby, and the like.

The receiving unit 201 transmits data based on the instruction to the condition decision unit 202.

The condition decision unit 202 decides whether the data transmitted from the receiving unit 201 is a display request for a performance that uses a performance image mapped by arranging three-dimensional objects in a three-dimensional virtual space and imaging the three-dimensional objects with a virtual camera.

The three-dimensional virtual space is also called "three-dimensional virtual environment". In the environment, virtual reality information on "length", "breadth", and "height" is spatially rendered so that objects are presented to the player as if in the real space. The information on "length" and "breadth" will also be referred to as information on "width" and "depth".

Three-dimensional objects are arranged in the three-dimensional virtual space to reproduce a virtual reality space.

A performance uses a performance image that is mapped by moving the virtual camera in the three-dimensional virtual space to image the three-dimensional objects.

Here, the virtual camera defines the viewpoint when displaying the three-dimensional objects arranged in the three-dimensional virtual space as a performance image on the liquid crystal display 31. The player operates the virtual camera which is the viewpoint of a character. The character is expressed as a three-dimensional object when applied to the three-dimensional virtual space. Hereinafter, such an object will be referred to as a "character object".

If the condition decision unit 202 decides that the data is a display request for a performance image that is mapped by imaging three-dimensional objects arranged in the three-dimensional virtual space with the virtual camera, the condition decision unit 202 issues a request for performance processing to the performance processing control unit 204. The condition decision unit 202 also instructs the information read unit 205 to read information, and requests the performance state determination unit 206 to determine the state of the performance of which display is requested.

Figure 25:
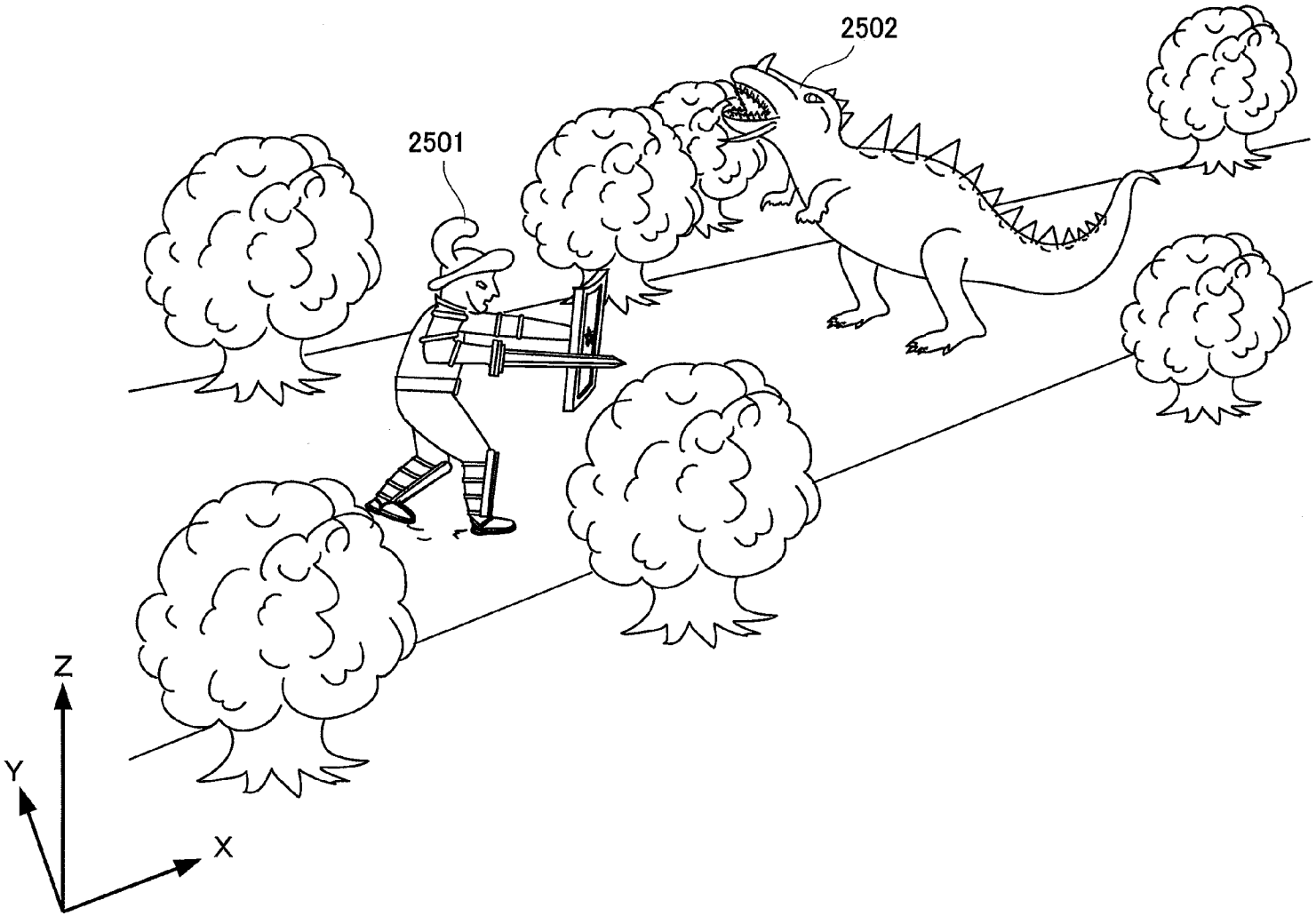
FIG. 25 is a diagram showing an example of a three-dimensional virtual space.

For example, FIG. 25 shows a three-dimensional virtual space in which three-dimensional objects are arranged. In the virtual space, a human character object and a monster character object are arranged along with background objects. FIG. 25 shows a scene in which the human character object 2501 and the monster character object 2502 are fighting each other. The virtual camera images the three-dimensional objects at any angle.

Figure 26A:
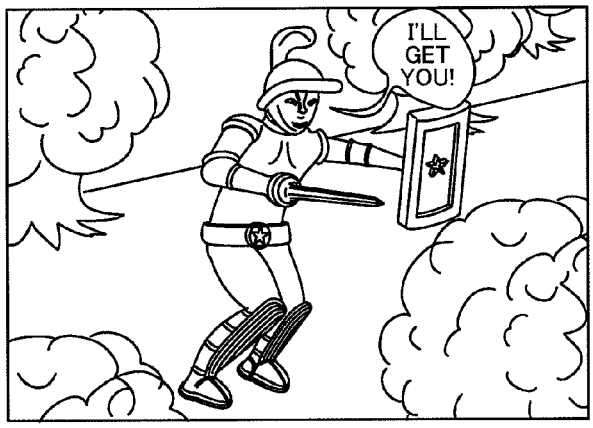
FIG. 26A to 26C are diagrams showing examples of performance images that are obtained by mapping the three-dimensional virtual space shown in FIG. 25 with a virtual camera.
Figure 26B:
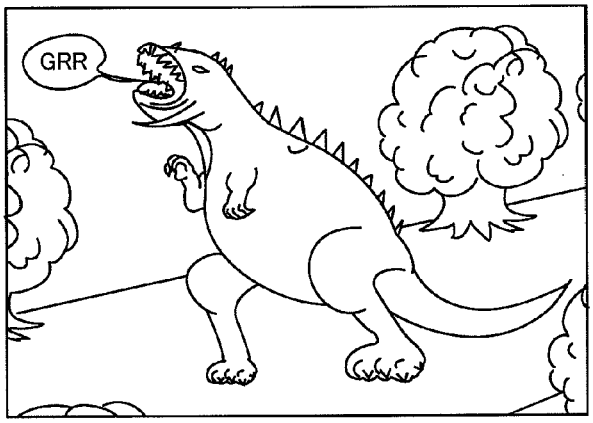
Figure 26C:
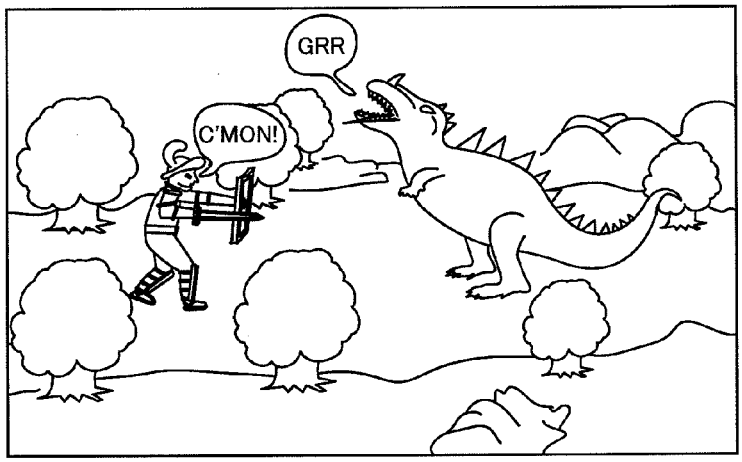

FIGS. 26A to 26C are diagrams showing the three-dimensional objects arranged in the three-dimensional virtual space shown in FIG. 25, imaged by the virtual camera. FIG. 26A shows a performance image that is imaged focusing on the human character object 2501. FIG. 26B shows a performance image that is imaged focusing on the monster character object 2502. FIG. 26C shows a performance image of the entire three-dimensional virtual space of FIG. 25.

If it is not determined that a display request for the display of such a performance image is received, the condition decision unit 202 requests the performance control processing unit 204 to create a display list based on the data for executing a predetermined performance (performance pattern specification command) from the performance control board 120. Here, the performance processing control unit 204 creates a display list based on the processing-requested performance pattern specification command, and transmits the created display list to the VDP 2000.

The VDP 2000 controls display on the performance image that is mapped by imaging the three-dimensional virtual space with the virtual camera.

The display control includes drawing (rendering) the performance image that is imaged and mapped by the virtual camera, and displaying the performance image on the liquid crystal display 31.

The drawing processing initially performs processing to determine the viewpoint which is defined by the virtual camera. The processing is intended to determine the range of sight from the camera. After the determination of the viewpoint, the display position on the display screen is determined when drawing the display image from the determined point of view.

Directional information on the camera, the degrees of magnification (zoom values), and the aspect ratio of the display screen are determined as the display position. In the three-dimensional virtual space, the zoom values to be set include a zoom value in the horizontal direction (horizontal zoom value) and a zoom value in the vertical direction (vertical zoom value). The horizontal zoom value can be expressed as a zoom value on the "X-Y plane", and the horizontal zoom value as a zoom value on the "X-Z plane".

After the determination of the display position on the display screen, objects to be seen are determined. That is, objects that are out of sight (not visible) from the viewpoint of the camera are excluded.

Parameter information for forming a display image to be displayed on the display screen is thus determined. Then, the coordinates of the apexes of geometric figures (also referred to as "primitives") or components that constitute the visible objects, such as polygons, are transformed from the coordinate systems of the object spaces of the respective objects into the coordinate system of a world space.

Subsequently, the coordinates of the objects transformed into the coordinate system of the world space are transformed into the coordinate system of a camera space that is in sight from the viewpoint of the camera. The camera space is a virtual space that depends on the camera which defines the viewpoint (the point of origin in the coordinate space) of the scene to be narrated by the display image.

Here, processing may be performed to increase or decrease the apex coordinates of the primitives (polygons) of the objects in the coordinate system of the camera space. Such processing can be performed by software such as a "geometry shader".

Culling processing is performed to delete geometric figures that are no longer needed in the camera space as a result of the coordinate transformation into the coordinate system of the camera space, from among the polygons or other primitives that constitute the three-dimensional objects. Clipping processing is also performed to clip only three-dimensional objects to be displayed on the display screen. That is, the areas other than clipped by the clipping processing will not be displayed.

The culling processing and clipping processing are not absolutely necessary, and are performed for the sake of reducing the load of rendering processing.

Subsequently, the apexes of the geometric figures (primitives) or components that constitute the three-dimensional objects are projected to map the spatial coordinates in the camera space onto two-dimensional screen space coordinates. This generates coordinates in a two-dimensional space.

As mentioned above, the mapping processing may be performed before the culling processing and clipping processing.

After the transformation of the three-dimensional objects into the screen space coordinates in the two-dimensional space, the coordinates are subjected to rasterization processing. The rasterization processing associates the polygons constituting the three-dimensional objects with pixels on the display screen so that the polygons can be displayed on the display screen as display images.

Shading processing (light source setting processing) is then performed to shade the rasterized display images. It is possible to perform alpha blending of multiplying the display images by α values to superpose a plurality of semitransparent images and Z-buffer processing of drawing only near side objects by using a depth information storing area (Z-buffer), if necessary.

Through such processing, the display images are rendered.

The display images rendered are displayed on the display screen of the display device, whereby the image from the viewpoint of the camera is displayed.

In this way, the rendering processing of the display control unit 213 is performed each time the virtual camera moves to a predetermined position, as well as each time the player makes an input operation on the performance button, an arrow key, and the like. That is, the rendering processing is performed for display each time a three-dimensional object moves.

When-instructed by the condition decision unit 202 to read information, the information read unit 205 then reads "performance state information" such as shown in FIG. 20 which is stored in the host ROM 150*c* and transmits the performance state information to the performance state information determination unit 206.

The performance state determination unit 206 determines the performance state of the display request When a determination request is given from the condition decision unit 202 and "performance state information" is transmitted from the information read unit 205.

For example, the performance state determination unit 206 determines which of "performance state 1," "performance 2," . . . in the "performance state information" shown in FIG. 20.

After determining the performance state of which the display request is requested by the determination unit 206, the performance state determination unit 206 transmits the "performance state information" read by the information read unit 205 and the information on the determined performance state to the sound output state information channel identification unit 207. Based on the transmitted information on the performance state, the sound output state information channel identification unit 207 counts the number of character objects appearing in the performance of that performance state from the "performance state information". The sound output state information channel identification unit 207 thereby determines whether a plurality of character objects appear, i.e., a plurality of character objects are associated with the performance state.

If a plurality of character objects are associated, the sound output state information channel identification unit 207 identifies the channels in "sound output state information" that are associated with the respective character objects.

If the channels of all the character objects associated with the performance in the performance state are identified, the sound output state information channel identification unit 207 transmits channel ID information on the "sound output state information" to the camera control unit 208. On the other hand, if the channels of all the character objects are not identified, the sound output state information channel identification unit 207 performs processing to identify the channel(s) of which the character object(s) is (are) unidentified.

In the channel identifying processing, the sound output state information channel identification unit 207 selects a channel or channels at random from among predetermined channels, or selects a channel or channels to which the highest priority is given.

After the channels are identified, the sound output state information channel identification unit 207 transmits the channel ID information on the sound output state information on all the character objects to the camera control unit 208.

Figures 21A, 21B:
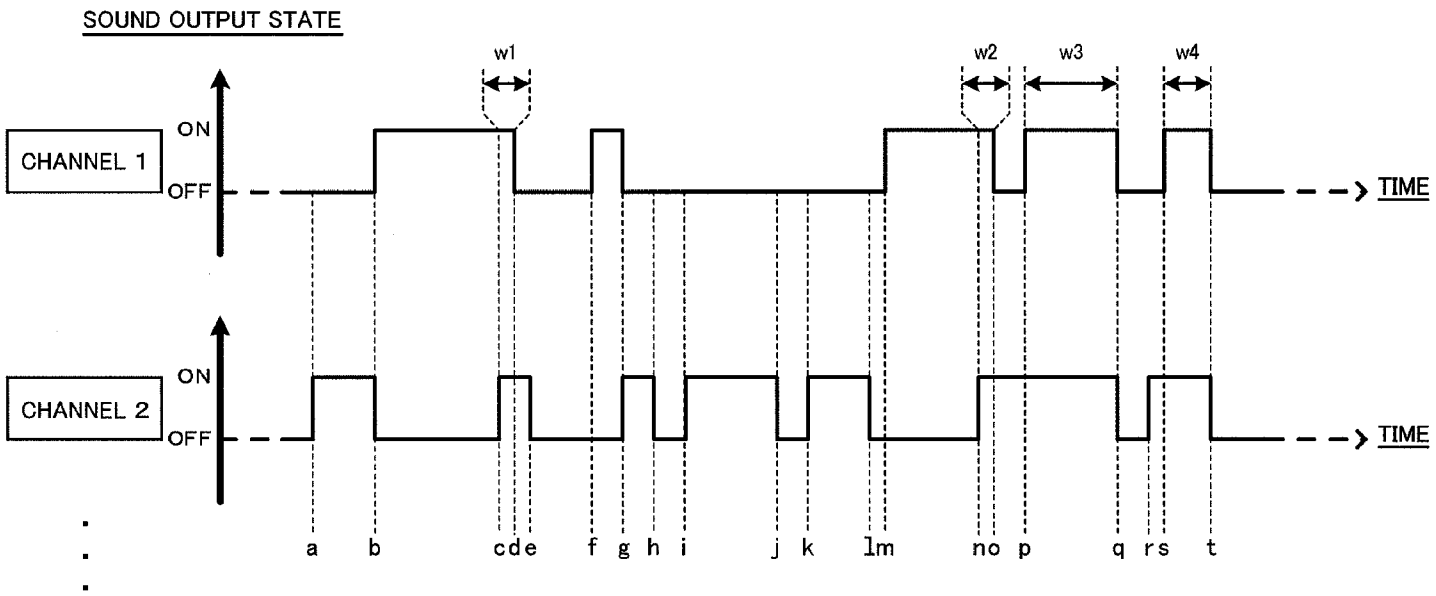
FIGS. 21A and 21B are diagrams showing an example of "sound output state information"

Based on the channel ID information on the sound output state information transmitted from the sound output state information channel identification unit 207, the camera control unit 208 acquires pieces of sound output state information corresponding to the channel ID information like ones shown in FIGS. 21A and 21B from the host ROM 150*c* as many as the number of channels associated with the character objects. The camera control unit 208 then performs camera control based on the sound output state information acquired.

For example, suppose that the performance state determination unit 206 determines that the performance state is "performance state 1". The sound output state information channel identification unit 207 identifies the channels of the sound output state information corresponding to the respective character objects based on the performance state information shown in FIG. 20.

More specifically, FIG. 20 includes a [performance state] field 2001, a [target object] field 2002, and a [sound output state information] field 2003. When the [performance state] field 2001 is the "performance state 1", the sound output state information channel identification unit 207 identifies the "character object A" and "character object B" specified in the [target object] field 2002 as the target objects of the "performance state 1".

The performance in the "performance state 1" refers to one for a battle scene of the human character object 2501 and the monster character object 2502 in the three-dimensional virtual space such as shown in FIG. 25.

With such three-dimensional objects (in the example shown in FIG. 25, the human character object 2501 and the monster character object 2502), the channel of the sound output state information on the "character object A", specified in the [sound output state information] field 2003, is identified as "channel 1". The channel of the sound output state information on the "character object B", specified in the [sound output state information] field 2003, is identified as "channel 2". Note that the "character object C" in the "performance state 2" has sound output state information "– (not specified) ". This means that the channel of the sound output state information is unidentifiable.

If it is impossible to identify the channel of the sound output state information on a three-dimensional object, the sound output state information channel identification unit 207 selects any of the channels at random.

The channels for all the objects are thereby identified.

After identifying each character object to make a sound output according to the sound output state information in the respective channels, the camera control unit 208 generates "camera motion information" which specifies the motion control on the virtual camera, and transmits the information to the performance processing control unit 204.

The performance processing control unit 204 then transmits the display list received from the condition decision unit 202, corresponding to the request for the creation of a display list based on the performance pattern specification command, and the camera motion information received from the camera control unit 208 to the VDP 2000.

Using the display list and the camera motion information, the VDP 2000 draws the performance image of the three-dimensional objects arranged in the three-dimensional virtual space, stored in the CG ROM 151.

The "camera motion information" generated by the camera control unit 208 is information for determining the state of operation of the virtual camera which serves as the viewpoint in the three-dimensional virtual space. The camera motion information covers the target objects to be imaged by the virtual camera and the motion control.

Figures 24A, 24B, 24C:
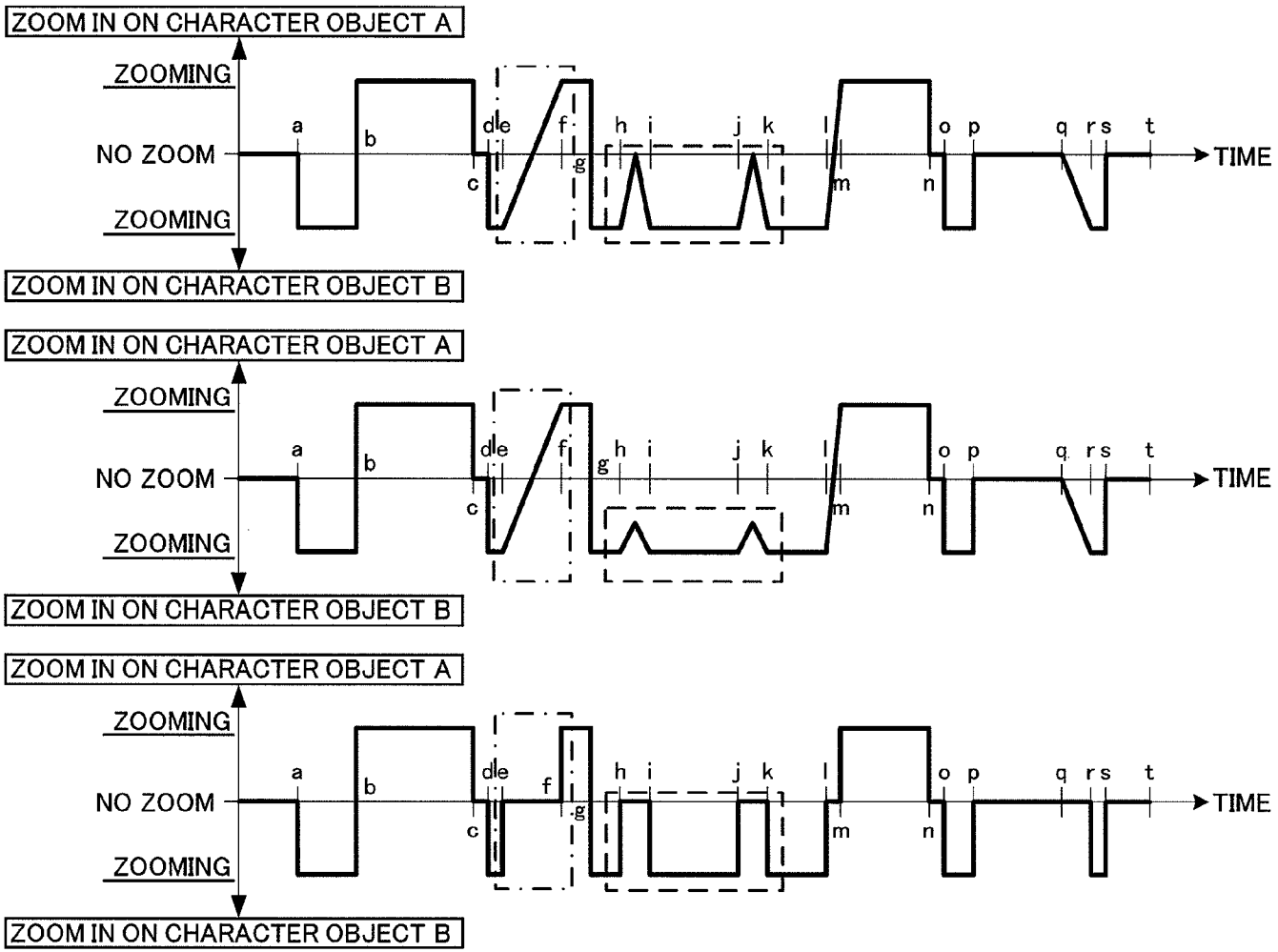
FIGS. 24A to 24C are diagrams showing examples of camera motion information.

Examples of the camera motion information are shown in FIGS. 24A to 24C.

FIGS. 24A to 24C show examples of camera control where two character objects are arranged as target objects in the three-dimensional virtual space shown in FIG. 25. The examples show camera controls of focusing on either one of the character objects.

FIGS. 24A to 24C show three types of camera motion information that defines the camera control in the three-dimensional virtual space of FIG. 25. The timing information (timing [a] to timing [t]) of FIGS. 24A to 24C corresponds to the timing information (timing [a] to timing [t]) in the sound output state information of FIGS. 21A and 21B.

FIG. 21A shows the sound output state information on the "channel 1". FIG. 21B shows the sound output state information on the "channel 2". If the channel of the "sound output state information" on a target object is set to the "channel 1", the sound output is performed in such a state as seen in the sound output state information shown in FIG. 21A. If the channel of the "sound output state information" on a target object is set to the "channel 2", the sound output is performed in such a state as seen in the sound output state information shown in FIG. 21B.

For the sound output states of FIGS. 21A and 21B, a state "ON" where sound is output and a state "OFF" where no sound is output are plotted on the vertical axis. The horizontal axis indicates the passage of time and a total of 20 arbitrary timing points including timing [a] to timing [t].

In the states shown in FIGS. 21A and 21B, the sound output of the monster character object 2502, for which the "channel 2" is specified, is initially performed at timing [a]. At timing [b], the sound output is stopped. At timing [c], the sound output is performed again. At timing [e], the sound output is stopped.

According to the sound output state information on the "channel 1" which is specified for the human character object 2501, no sound output is performed at timing [a]. At timing [b], a sound output is performed. At timing [d], the sound output is stopped.

From timing [c] to timing [d], the sound output of the human character object 2501 and the monster character object 2502 is simultaneously performed.

From timing [e] to timing [f], no sound output of the human character object 2501 or the monster character object 2502 is performed. At timing [f], the sound output of the human character object 2501 is started.

Meanwhile, at timing [a] of the camera motion information shown in FIG. 24, the camera is focused on the monster character object 2502 which is the character object B whose sound output is being performed. The focus is maintained until timing [b].

From timing [b] to timing [c], the camera is focused on the human character object 2501 since the sound output of the human character object 2501, or character object A, is being performed.

From timing [c] to timing [d], the camera is focused on both the human character object 2501 and the monster character object 2502 since the sound output of the human character object 2501 and the monster character object 2502 is being performed.

At timing [e], the sound output of the monster character object 2502 is followed by a soundless state, which continues until the sound output of the human character object 2501. The camera motion information of FIGS. 24A and 24B shows that the camera is controlled to switch gradually from the monster character object 2502 to the human character object 2501 when the sound output of the different character object is performed after the soundless state. In FIG. 24C, the soundless state is accompanied by the absence of camera zoom-in.

During the timing [h] to timing [k] of FIGS. 24A to 24C, either one of the character objects is in a soundless state and the sound output of the same character object is performed before and after the soundless state. In the above-mentioned period shown in FIG. 24A, the camera may be once put into a "no zoom" state before zoomed in on the same character again. In the above-mentioned timing of FIG. 24B, the camera may be kept in focus and zoomed out, but not fully zoomed out. In the above-mentioned timing of FIG. 24C, the camera may be operated without zooming.

Such a camera control is generated by the camera control unit 208 and transmitted from the performance processing control unit 204 to the VDP 2000.

Figure 7:
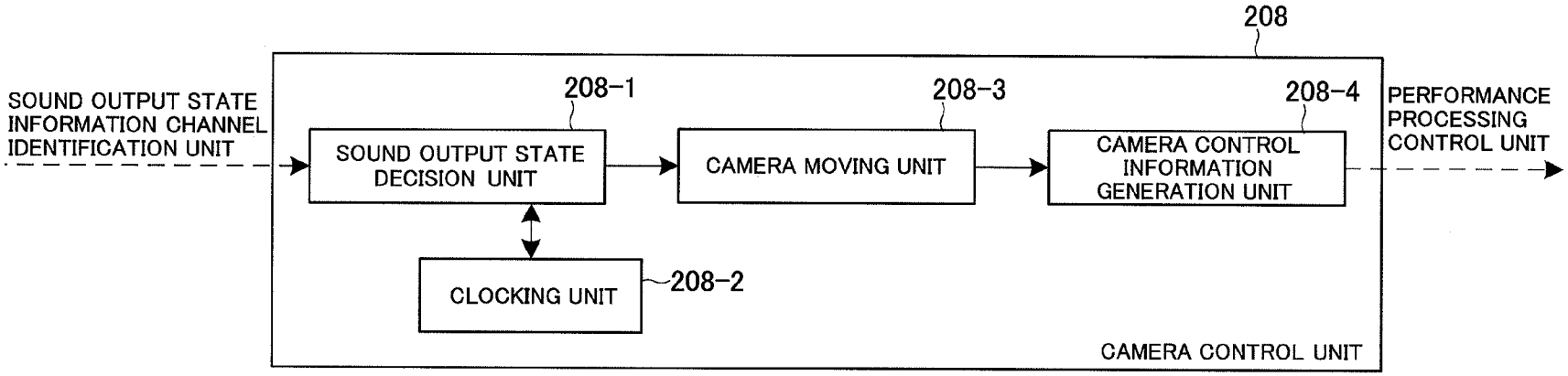
FIG. 7 is a block diagram showing the detailed configuration of a camera control unit 208 shown in FIG. 6.

FIG. 7 is a block diagram showing the detailed configuration of the camera control unit 208 shown in FIG. 6.

In FIG. 7, the camera control unit 208 includes a sound output state decision unit 208-1, a clocking unit 208-2, a camera moving unit 208-3, and a camera control information generation unit 208-4. When the camera control unit 208 receives the channel ID information on the sound output state information on each character object from the sound output state information channel identification unit 207, the clocking unit 208-2 clocks the sound output of the character object that corresponds to the sound output state information identified by the channel ID information.

The clocking unit 208-2 clocks, and the sound output state decision unit 208-1 decides the state of sound output of each object.

The camera moving unit 208-3 operates the camera depending on the state where a sound output is performed and the state where no sound output is performed, based on the state of the sound output decided by the sound output state decision unit 208-1. The camera control information generation unit 208-4 generates camera control information which indicates the state of operation.

The camera control information generated by the camera control information generation unit 208-4 is transmitted to the performance processing control unit 204.

Figure 8:
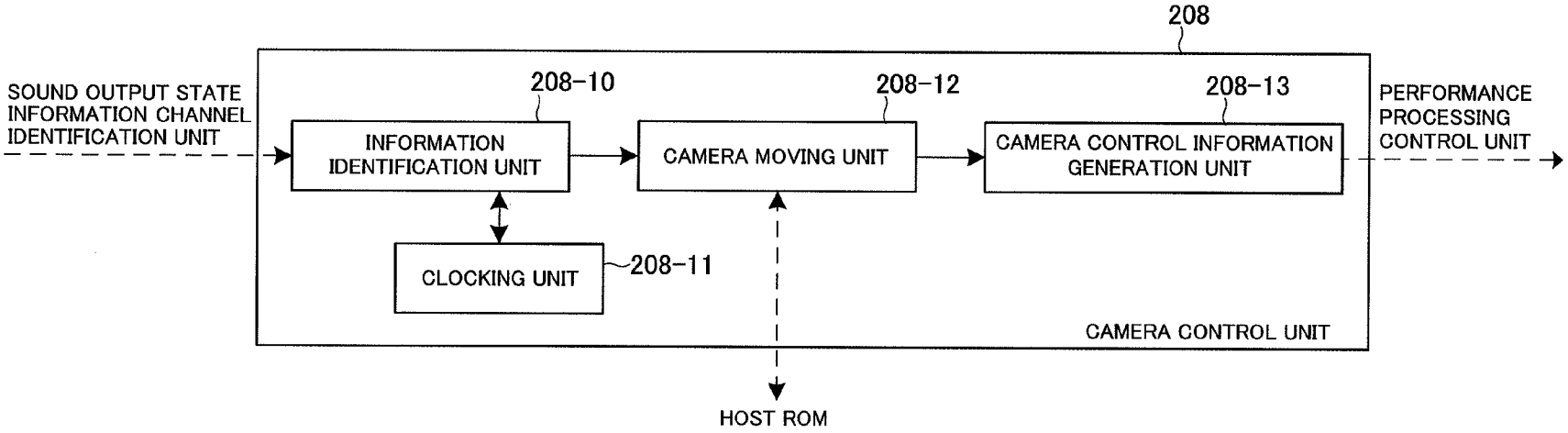
FIG. 8 is another example of the block diagram showing the detailed configuration of the camera control unit 208 shown in FIG. 6.

FIG. 8 is another example of the block diagram showing the detailed configuration of the camera control unit 208 shown in FIG. 6.

In FIG. 8, the camera control unit 208 includes an information identification unit 208-10, a clocking unit 208-11, a camera moving unit 208-12, and a camera control information generation unit 208-13. When the information identification unit 208-10 receives the channel ID information from the sound output state information channel identification unit 207, camera motion information such as shown in FIGS. 24A to 24C is identified from the sound output state information on the channels such as shown in FIGS. 21A and 21B. The camera moving unit 208-12 operates the camera by using the camera motion information.

Based on the operation of the camera moving unit 208-12, the camera control information generation unit 208-13 generates camera control information.

Next, the progress of a game with the game machine 1 will be described with reference to flowcharts.

Figure 9:
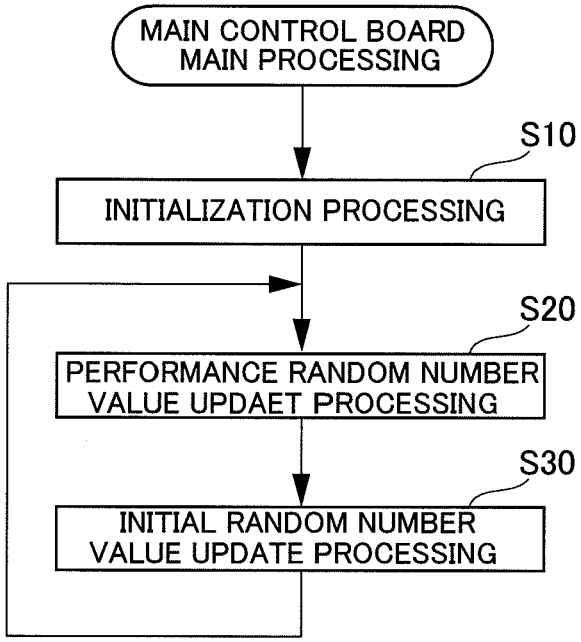
FIG. 9 is a flowchart showing the detailed procedure of main processing to be performed by a main control board which constitutes the block diagram of the entire game machine shown in FIG. 4.

Referring to FIG. 9, the main processing of the main control board 110 will be described.

When power is supplied from the power supply board 170, a system reset occurs in the main CPU 110*a*. The main CPU 110*a* performs the following main processing.

Initially, at step S10, the main CPU 110*a* performs initialization processing. In the processing, the main CPU 110*a* loads a startup program from the main ROM 110*b* in response to the power-on, and performs processing to initialize flags and the like stored in the main RAM 110*c*.

At step S20, the main CPU 110*a* performs performance random number value update processing to update a reach judgment random number value and a special symbol variation random number value which are intended to determine the variation mode (variation time) of special symbols.

At step S30, the main CPU 110*a* updates a special symbol judgment initial random number value, a jackpot symbol initial random number value, a small jackpot symbol initial random number value, and a normal symbol judgment initial random number value. Subsequently, the main CPU 110*a* repeats the processing of steps S20 and S30 until predetermined interrupt processing is performed.

Figure 10:
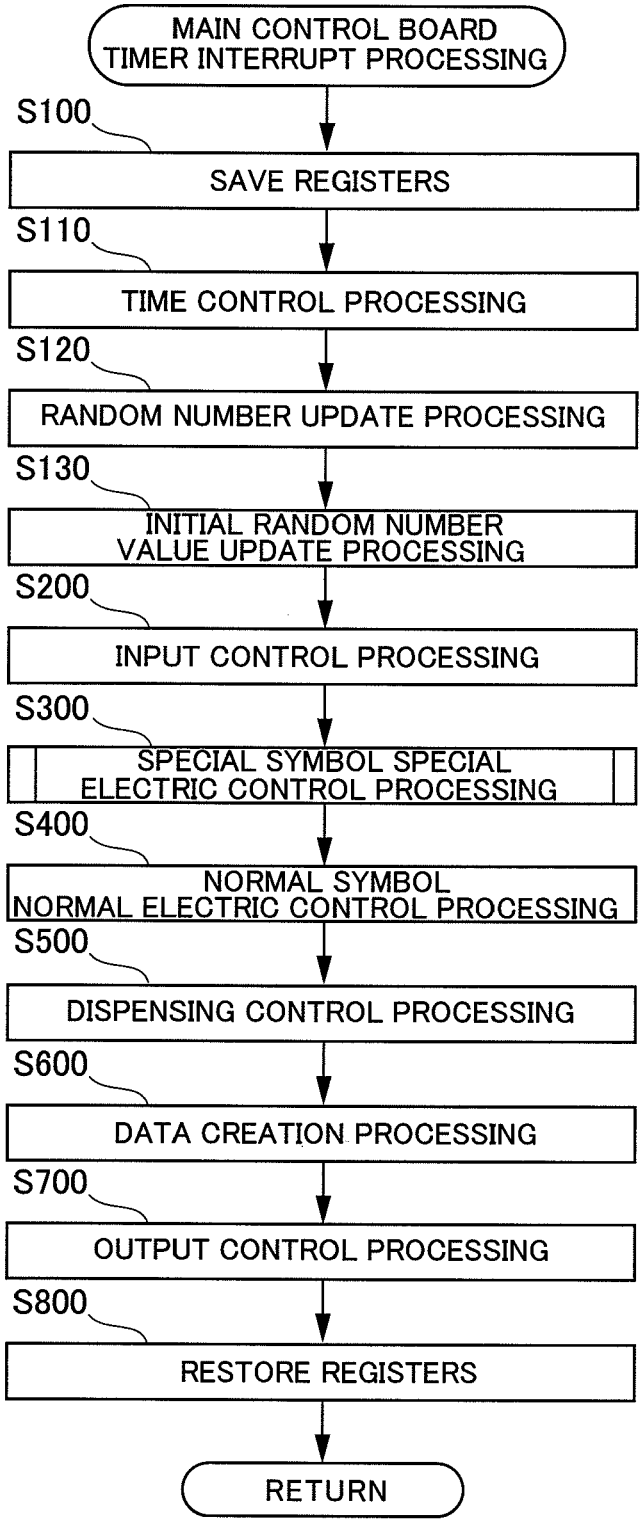
FIG. 10 is a flowchart showing the detailed procedure of timer interrupt processing performed by the main control board which constitutes the block diagram of the entire game machine shown in FIG. 4.

Referring to FIG. 10, timer interrupt processing of the main control board 110 will be described.

A resetting clock pulse generation circuit provided on the main control board 110 generates a clock pulse at predetermined intervals (4 ms), which initiates the following timer interrupt processing.

Initially, at step S100, the main CPU 110*a* saves the information stored in the registers of the main CPU 110*a* into a stack area.

At step S110, the main CPU 110*a* performs time control processing to update various types of timer counters. The time control processing includes the processing of updating the special symbol time counter, the processing of updating the special game timer counter which pertains to the open time of special electrical gadgets and the like, the processing of updating a normal symbol time counter, and the processing of updating a normal electric open time counter. Specifically, the main CPU 110*a* performs processing to subtract 1 from each of the special symbol time counter, the special game timer counter, the normal symbol time counter, and the normal electric open time counter.

At step S120, the main CPU 110*a* performs random number update processing on the special symbol judgment random number value, the jackpot symbol random number value, the small jackpot symbol random number value, and the normal symbol judgment random number value.

Specifically, the main CPU 110*a* adds 1 to the random number values and random number counters for update. If an added random number counter exceeds the maximum value of its random number range, the main CPU 110*a* resets the random number counter to 0 and updates the random number values anew from the respective initial random number values at that time.

At step S130, the main CPU 110*a* performs initial random number value update processing to update the special symbol judgment initial random number value, the jackpot symbol initial random number value, the small jackpot symbol initial random number value, and the normal symbol judgment initial random number value as in step S30.

At step S200, the main CPU 110*a* performs input control processing.

In the processing, the main CPU 110*a* performs input processing to determine whether there is an input to each of the general prize hole detection switch 12*a*, the first bonus prize hole detection switch 16*a*, the second bonus prize hole detection switch 17*a*, the first start hole detection switch 14*a*, the second start hole detection switch 15*a*, and the gate detection switch 13*a*.

Specifically, when various detection signals are input from the general prize hole detection switch 12*a*, the first bonus prize hole detection switch 16*a*, the second bonus prize hole detection switch 17*a*, the first start hole detection switch 14*a*, and the second start hole detection switch 15*a*, the main CPU 110*a* adds predetermined data to each of winning ball counters for update. The winning ball counters are arranged for the each prize hole and used for winning balls.

If the detection signal from the first start hole detection switch 14*a* is input and the data set in the first special symbol reserved number (U1) storing area is smaller than 4, the main CPU 110*a* adds 1 to the first special symbol reserved number (U1) storing area. The main CPU 110*a* then acquires the special symbol judgment random number value, the jackpot symbol random number value, the small jackpot symbol random number value, the reach judgment random number value, and the special symbol variation random number value, and stores the acquired various random number values into a predetermined storing section (zeroth storing section to fourth storing section) in the first special symbol random number value storing area.

Similarly, if the detection signal from the second start hole detection switch 15*a* is input and the data set in the second special symbol reserved number (U2) storing area is smaller than 4, the main CPU 110*a* adds 1 to the second special symbol reserved number (U2) storing area. The main CPU 110*a* then acquires the special symbol judgment random number value, the jackpot symbol random number value, the small jackpot symbol random number value, the reach judgment random number value, and the special symbol variation random number value, and stores the acquired various random number values into a predetermined storing section (zeroth storing section to fourth storing section) in the second special symbol random number value storing area.

If the detection signal from the gate detection switch 13*a* is input and the data set in the normal symbol reserved number (G) storing area is smaller than 4, the main CPU 110*a* adds 1 to the normal symbol reserved number (G) storing area. The main CPU 110*a* then acquires the normal symbol judgment random number value, and stores the acquired normal symbol judgment random number value into a predetermined storing section (zeroth storing section to fourth storing section) in the normal symbol reservation storing area.

If the detection signal from the first bonus prize hole detection switch 16*a* or the second bonus prize hole detection switch 17*a* is input, the main CPU 110*a* adds 1 to the bonus prize hole entering ball number (C) storing area for update. The bonus prize hole entering ball number (c) storing area is intended to count game balls entering the first bonus prize hole 16 or the second bonus prize hole 17.

At step S300, the main CPU 110*a* performs special symbol special electric control processing for performing jackpot drawing and controlling the special electrical gadget and the game state.

At step S400, the main CPU 110*a* performs normal symbol normal electric control processing for performing normal symbol drawing and controlling the normal electrical gadgets.

Specifically, the main CPU 110*a* initially determines if value of one or higher is set in the normal symbol reserved number (G) storing area. The main CPU 110*a* ends the normal symbol normal electric control processing this time unless value of one or higher is set in the normal symbol reserved number (G) storing area.

If value of one or higher is set in the normal symbol reserved number (G) storing area, the main CPU 110*a* subtracts 1 from the value stored in the normal symbol reserved number (G) storing area. The main CPU 110*a* then shifts the normal symbol judgment random number values stored in the first to fourth storing sections of the normal symbol reservation storing area to the respective preceding storing sections. This shift results in overwriting and erasing the normal symbol judgment random number value that is previously written in the zeroth storing section.

Then, the main CPU 110*a* performs processing to determine whether the normal symbol judgment random number value stored in the zeroth storing section of the normal symbol reservation storing area corresponds to a "win". Subsequently, the normal symbol display device 22 displays normal symbols with variations and after a lapse of the normal symbol variation time displays without variations the normal symbol that corresponds to the result of normal symbol drawing. If the normal symbol judgment random number value referenced hits a "win", the start hole opening and closing solenoid 15*c* is driven to control the second start hole 15 to the second mode for a predetermined open time.

When in a non-quick game state, the normal symbol variation time is set to 29 sec. If "win", the second start hole 15 is controlled to the second mode for 0.2 sec. On the other hand, when in the quick game state, the normal symbol variation time is set to 0.2 sec. If "win", the second start hole 15 is controlled to the second mode for 3.5 sec.

At step S500, the main CPU 110*a* performs dispensing control processing.

In the dispensing control processing, the main CPU 110*a* references the winning ball counters to generate dispensing number specification commands corresponding to the respective prize holes, and transmits the generated dispensing number specification commands to the dispensing control board 130.

At step S600, the main CPU 110*a* performs processing to generate external information data, start hole opening and closing solenoid data, first bonus prize hole opening and closing solenoid data, second bonus prize hole opening and closing solenoid data, special symbol display device data, normal symbol display device data, and data on a stored number specification command.

At step S700, the main CPU 110*a* performs output control processing. In the processing, the main CPU 110*a* performs port output processing to output the signals of the external information data, the start hole opening and closing solenoid data, the first bonus prize hole opening and closing solenoid data, and the second bonus prize hole opening and closing solenoid data which are created in the foregoing step S600.

In order to light the LEDs of the first special symbol display device 20, the second special symbol display device 21, and the normal symbol display device 22, the main CPU 110*a* performs display device output processing to output the special symbol display device data and the normal symbol display device data which are created in the foregoing step S600.

The main CPU 110*a* also performs command transmission processing to transmit commands set in the performance transmission data storage area of the main RAM 110*c* to the performance control board 120.

At step S800, the main CPU 110*a* restores the information saved in step S100 into the registers of the main CPU 110*a*.

Figure 11:
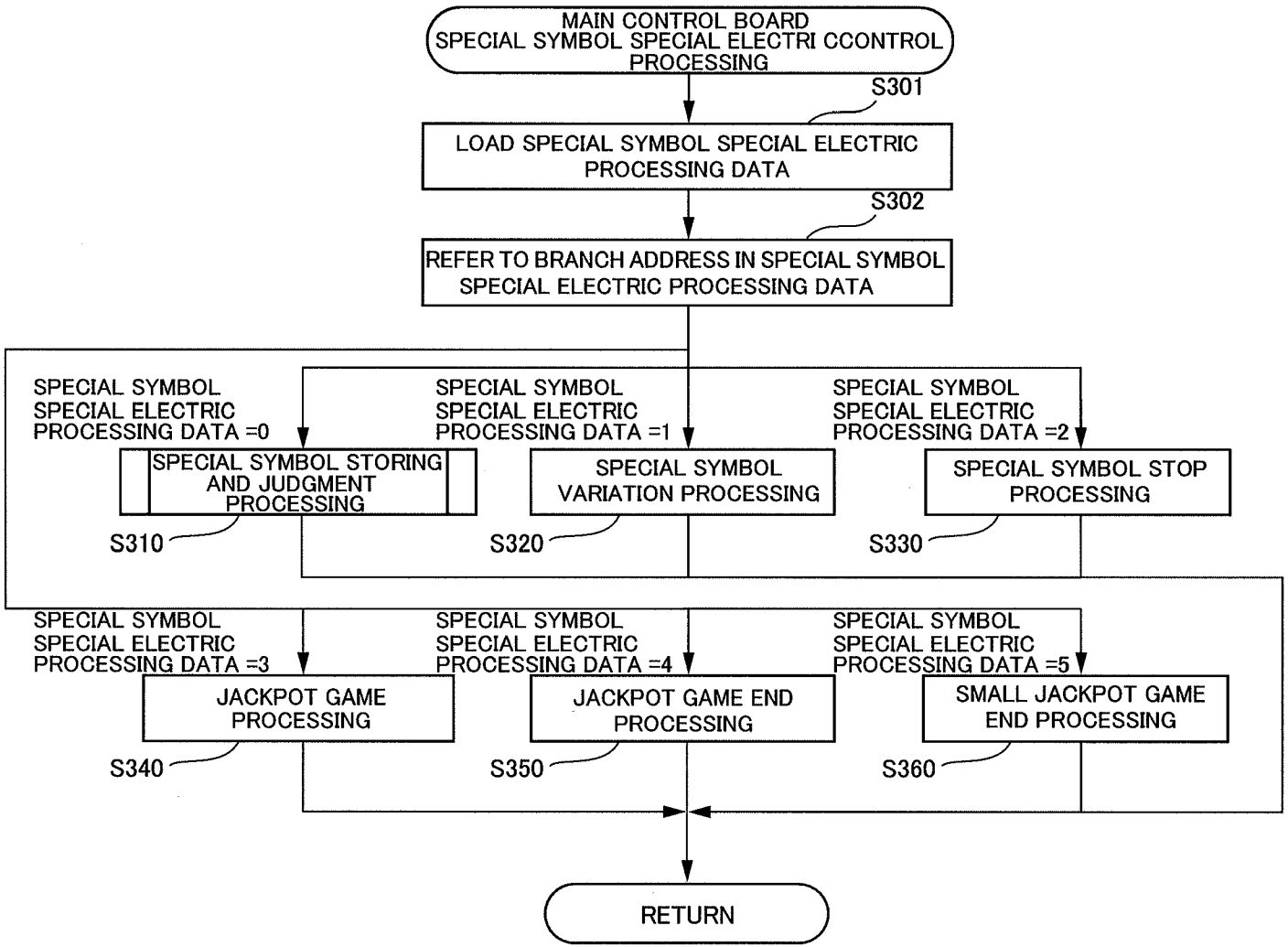
FIG. 11 is a flowchart showing the detailed procedure of special symbol special electric control processing to be performed by the main control board which constitutes the block diagram of the entire game machine shown in FIG. 4.

Referring to FIG. 11, the special symbol special electric control processing of the main control board 110 will be described.

Initially, at step S301, the main CPU 110*a* loads the value of special symbol special electric processing data. At step S302, the main CPU 110*a* refers to a branch address included in the special symbol special electric processing data loaded. If the special symbol special electric processing data=0, the main CPU 110*a* shifts the processing to special symbol storing and judgment processing (step S310). If the special symbol special electric processing data=1, the main CPU 110*a* shifts the processing to special symbol variation processing (step S320). If the special symbol special electric processing data=2, the main CPU 110*a* shifts the processing to special symbol stop processing (step S330). If the special symbol special electric processing data=3, the main CPU 110*a* shifts the processing to jackpot game processing (step S340). If the special symbol special electric processing data=4, the main CPU 110*a* shifts the processing to jackpot game end processing (step S350). If the special symbol special electric processing data=5, the main CPU 110*a* shifts the processing to small jackpot game end processing (step S360).

The "special symbol special electric processing data" is set in each subroutine of the special symbol special electric control processing when necessary, so that subroutines necessary for a game are processed appropriately.

Figure 12:
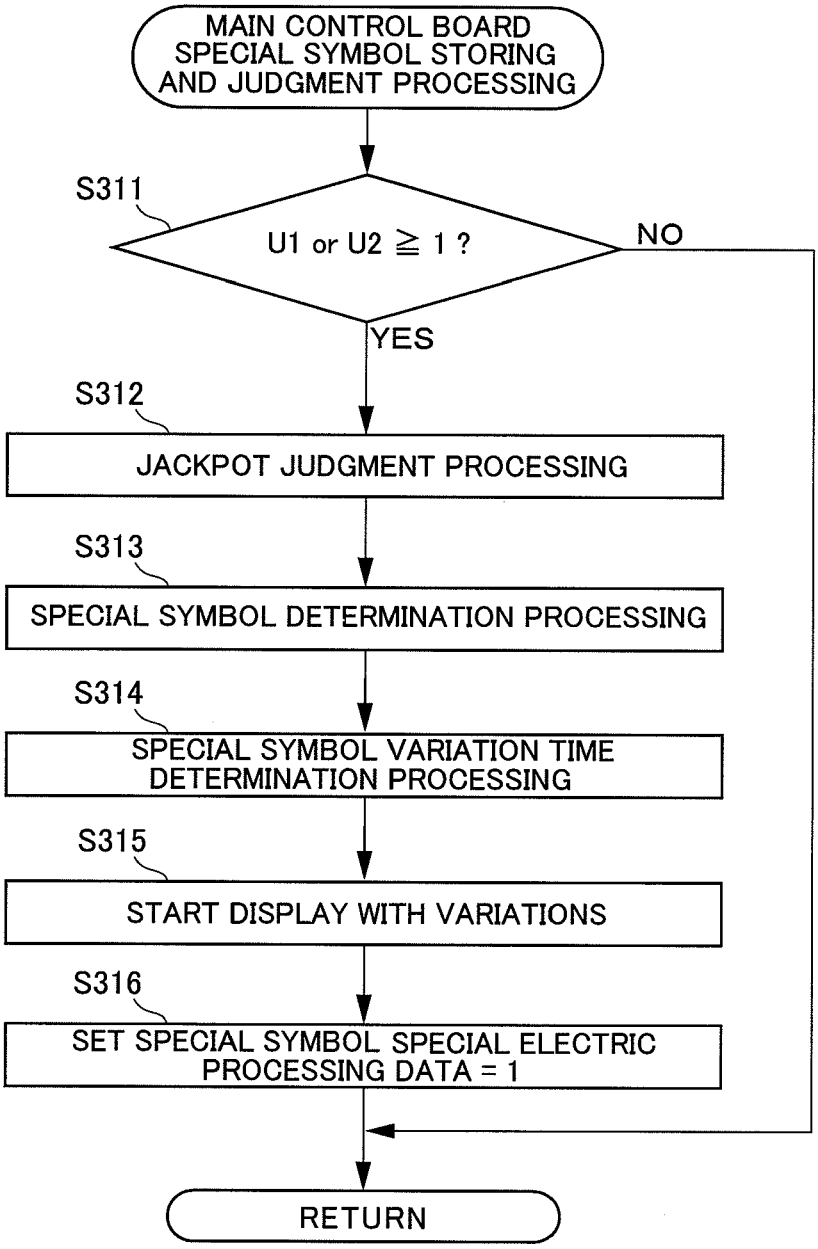
FIG. 12 is a flowchart showing the detailed procedure of special symbol storing and judgment processing performed by the main control board which constitutes the block diagram of the entire game machine shown in FIG. 4.

In the special symbol storing and judgment processing of step S310, the main CPU 110*a* performs such processing as jackpot judgment processing, special symbol determination processing for determining a special symbol to remain to be displayed, and variation time determination processing for determining the special symbol variation time. Referring to FIG. 12, the special symbol storing and judgment processing will now be described in the concrete.

FIG. 12 is a flowchart showing the special symbol storing and judgment processing of the main control board 110.

Initially, at step S311, the main CPU 110*a* judges whether data of 1 or higher is set in the first special symbol reserved number (U1) storing area or the second special symbol reserved number (U2) storing area.

If data of 1 or higher is set in neither of the first special symbol reserved number (U1) storing area or the second special symbol reserved number (U2) storing area, the main CPU 110*a* ends the special symbol storing and judgment processing this time while maintaining the special symbol special electric processing data=0.

On the other hand, if data of 1 or higher is set in the first special symbol reserved number (U1) storing area or the second special symbol reserved number (U2) storing area, the main CPU 110*a* shifts the processing to step S312.

At step S312, the main CPU 110*a* performs the jackpot judgment processing.

Specifically, if data of 1 or higher is set in the second special symbol reserved number (U2) storing area, the main CPU 110*a* subtracts 1 from the value stored in the second special symbol reserved number (U2) storing area. The main CPU 110*a* then shifts the various random number values stored in the first to fourth storing sections of the second special symbol random number value storing area to the respective preceding storing sections. This overwrites and erases the various random number values that are previously written in the zeroth storing section. The main CPU 110*a* then judges whether the special symbol judgment random number value stored in the zeroth storing section of the second special symbol random number value storing area corresponds to a "jackpot", or whether the random number value corresponds to a "small jackpot".

If data of 1 or higher is not set in the second special symbol reserved number (U2) storing area and data of 1 or higher is set in the first special symbol reserved number (U1) storing area, the main CPU 110*a* subtracts 1 from the value stored in the first special symbol reserved number (U1) storing area. The main CPU 110*a* then shifts the various random number values stored in the first to fourth storing sections of the first special symbol random number value storing area to the respective preceding storing sections. Again, this overwrites and erases the various random number values that are previously written in the zeroth storing section. The main CPU 110*a* then judges whether the special symbol judgment random number value stored in the zeroth storing section of the first special symbol random number value storing area corresponds to a "jackpot", or whether the random number value corresponds to a "small jackpot".

In the present embodiment, the random number values stored in the second special symbol random number value storing area are shifted (consumed) with priority over those stored in the first special symbol random number value storing area.

However, this is not restrictive. The first special symbol random number value storing area and the second special symbol random number value storing area may be shifted in order of entry into the start holes. The first special symbol random number value storing area may be shifted with priority over the second special symbol random number value storing area.

At step S313, the main CPU 110*a* performs the special symbol determination processing for determining the type of the special symbol to remain to be displayed.

In the special symbol determination processing, the main CPU 110*a* determines a jackpot symbol based on the jackpot symbol random number value stored in the zeroth storing section of the first special symbol random number value storing area if the foregoing jackpot judgment processing (step S312) results in a "jackpot". If the foregoing jackpot judgment processing (step S312) results in a "small jackpot", the main CPU 110*a* determines a small jackpot symbol based on the small jackpot symbol random number value stored in the zeroth storing section of the first special symbol random number value storing area. If the foregoing jackpot judgment processing (step S312) results in a "miss", the main CPU 110*a* determines a miss symbol.

The main CPU 110*a* then stores stop symbol data corresponding to the determined special symbol into the stop symbol data storing area.

At step S314, the main CPU 110*a* performs the variation time determination processing for the special symbol.

Specifically, the main CPU 110*a* determines the variation pattern of special symbols based on the reach judgment random number value and the special symbol variation random number value stored in the zeroth storing section of the first special symbol random number value storing area. Subsequently, the main CPU 110*a* determines the special symbol variation time corresponding to the variation pattern of special symbols determined. The main CPU 110*a* then performs processing to set the special symbol time counter to a counter value corresponding to the special symbol variation time determined.

At step S315, the main CPU 110*a* sets variation display data for making the first special symbol display device 20 or the second special symbol display device 21 display special symbols with variations (LED blinking), into a predetermined processing area. With the variation display data set in the predetermined processing area, data for turning on/off the LEDs is appropriately created in the foregoing step S600. The created data is output at step S700, whereby the first special symbol display device 20 or the second special symbol display device 21 makes a display with variations.

When starting to display special symbols with variations, the main CPU 110*a* sets a special symbol variable pattern specification command (first special symbol variation pattern specification command or second special symbol variation pattern specification command) that corresponds to the variation pattern of special symbols determined in the foregoing step S314, into the performance transmission data storage area of the main RAM 110*c*.

At step S316, the main CPU 110*a* changes "the special symbol special electric processing data=0" to "the special symbol special electric processing data=1", thereby preparing for a shift into the subroutine for the special symbol variation processing. The main CPU 110*a* then ends the special symbol storing and judgment processing.

Figure 13:
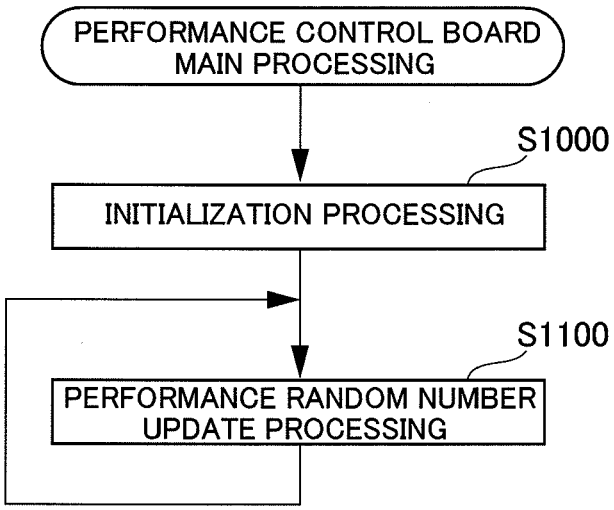
FIG. 13 is a flowchart showing the detailed procedure of main processing performed by a performance control board which constitutes the block diagram of the entire game machine shown in FIG. 4.

Referring to FIG. 13, the main processing of the performance control board 120 will be described.

At step S1000, the sub CPU 120*a* performs initialization processing. In the processing, the sub CPU 120*a* loads a main processing program from the sub ROM 120*b* in response to the power-on, and performs processing to initialize and set flags and the like stored in the sub RAM 120*c*. After the end of the processing, the sub CPU 120*a* shifts the processing to step S1400.

At step S1100, the sub CPU 120*a* performs performance random number update processing. In the processing, the sub CPU 120*a* performs processing to update random numbers (such as performance random number value 1, performance random number value 2, performance symbol determination random number value, and performance mode determination random number value) stored in the sub RAM 120*c*. Subsequently, the sub CPU 120*a* repeats the processing of the step S1100 described above until predetermined interrupt processing is performed.

Figure 14:
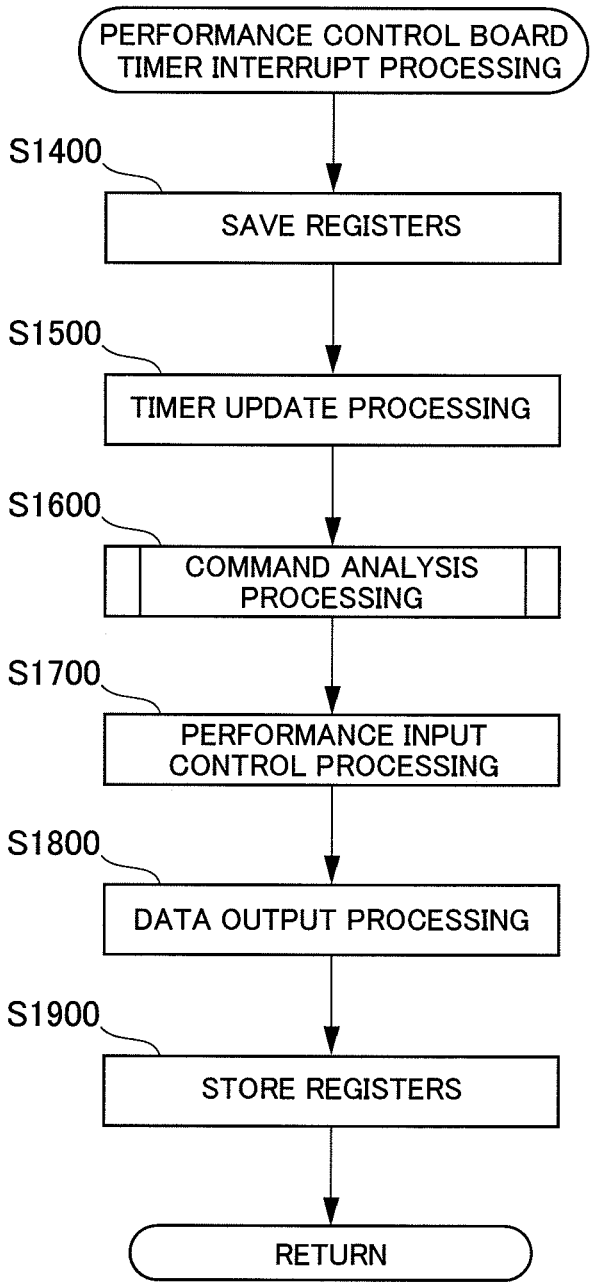
FIG. 14 is a flowchart showing the detailed procedure of timer interrupt processing performed by the performance control board which constitutes the block diagram of the entire game machine shown in FIG. 4.

Referring to FIG. 14, timer interrupt processing of the performance control board 120 will be described.

A not-shown resetting clock pulse generation circuit provided on the performance control board 120 generates a clock pulse at predetermined intervals (2 ms). A timer interrupt processing program is loaded, and the timer interrupt processing of the performance control board is performed.

Initially, at step S1400, the sub CPU 120*a* saves the information stored in the registers of the sub CPU 120*a* to a stack area. At step S1500, the sub CPU 120*a* performs processing to update various timer counters that are used in the performance control board 120.

At step S1600, the sub CPU 120*a* performs command analysis processing.

In the processing, the sub CPU 120*a* performs processing to analyze a command that is stored in a reception buffer of the sub RAM 120*c*. The command analysis processing will be detailed later with reference to FIGS. 15 and 16. When the performance control board 120 receives a command transmitted from the main control board 110, not-shown command reception interrupt processing occurs in the performance control board 120, whereby the received command is stored into the reception buffer. Subsequently, the processing of analyzing the received command is performed in this step S1600.

At step S1700, the sub CPU 120*a* checks for the signal of the performance button detection switch 35*a*, and performs performance input control processing on the performance button 35.

At step S1800, the sub CPU 120*a* performs data output processing to transmit various types of commands set in a transmission buffer of the sub RAM 120*c* to the lamp control board 140 and the image control board 150.

At step S1900, the sub CPU 120*a* restores the information saved in step S1400 to the registers of the sub CPU 120*a*.

Figure 15:
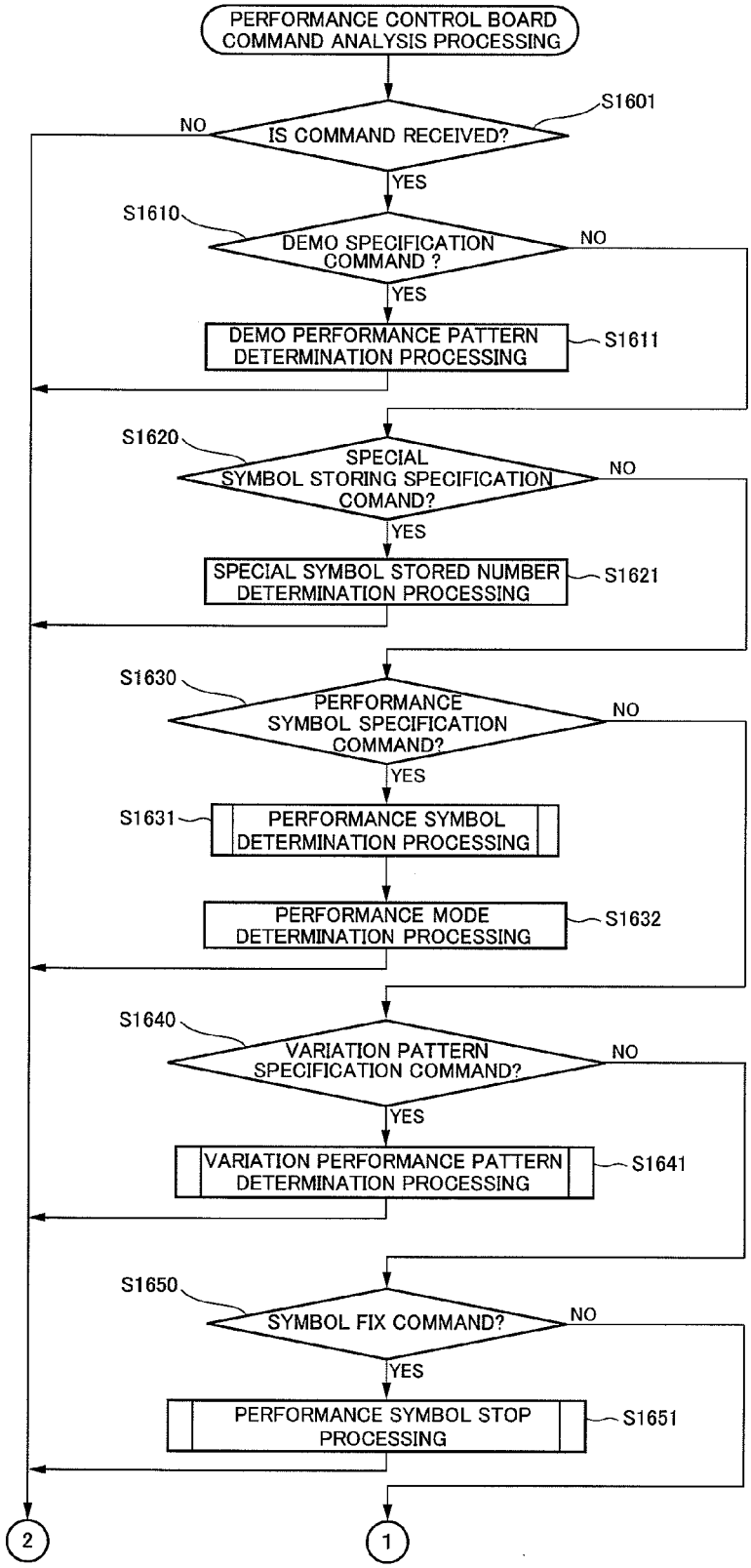
FIG. 15 is a flowchart showing the detailed procedure of command analysis processing performed by the performance control board which constitutes the block diagram of the entire game machine shown in FIG. 4.
Figure 16:
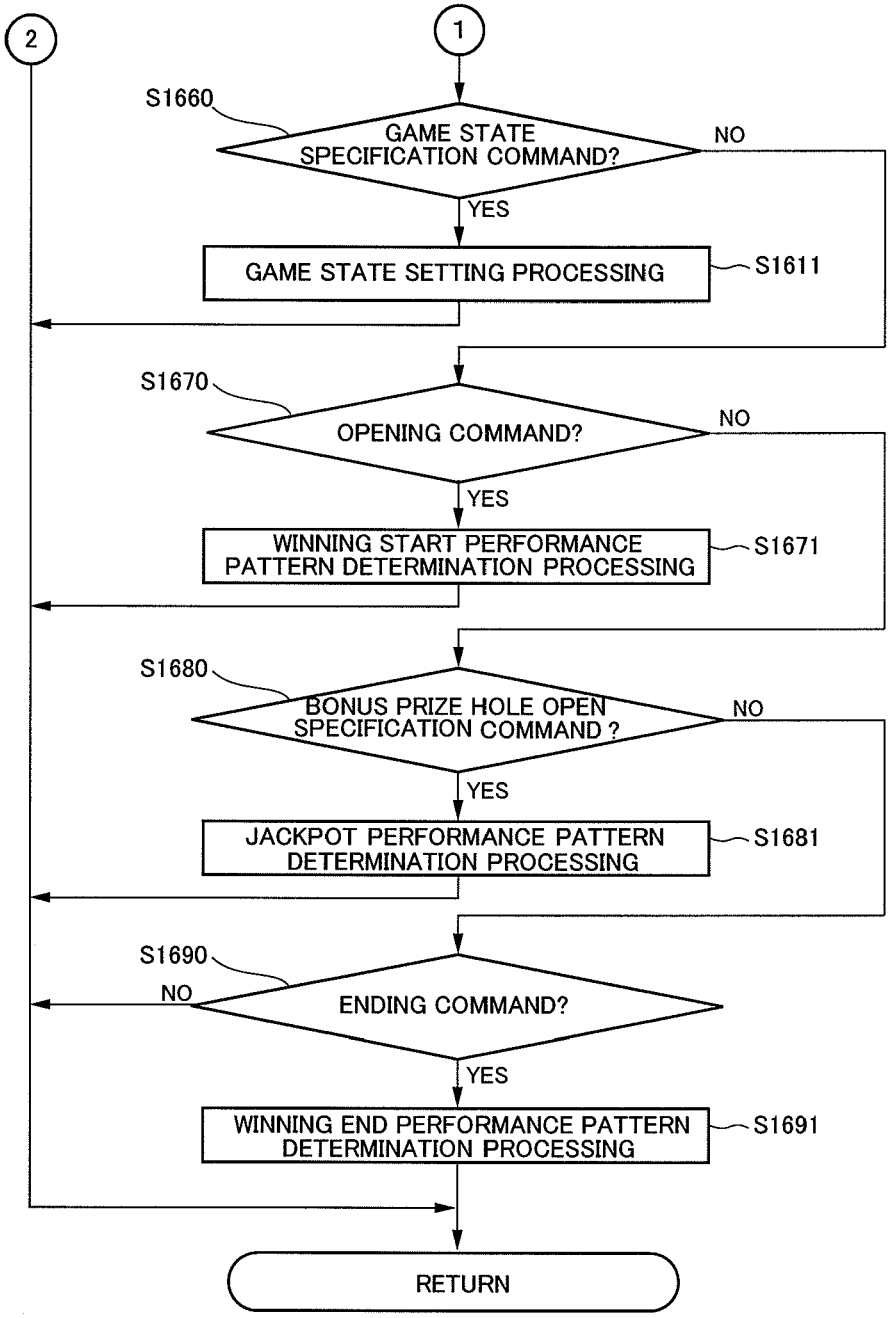
FIG. 16 is a flowchart showing the detailed procedure continued from that of the command analysis processing performed by the performance control board shown in FIG. 15.

Referring to FIGS. 15 and 16, the command analysis processing of the performance control board 120 will be described. It should be appreciated that the command analysis processing 2 of FIG. 16 is performed in succession to the command analysis processing 1 of FIG. 15.

At step S1601, the sub CPU 120*a* checks for the presence or absence of a command in the reception buffer, thereby checking for command reception.

If there is no command in the reception buffer, the sub CPU 120*a* ends the command analysis processing. If there is a command in the reception buffer, the sub CPU 120*a* shifts the processing to step S1610.

At step S1610, the sub CPU 120*a* checks whether the command stored in the reception buffer is a demo specification command.

If the command stored in the reception buffer is a demo specification command, the sub CPU 120*a* shifts the processing to step S1611. If not a demo specification command, the sub CPU 120*a* shifts the processing to step S1620.

At step S1611, the sub CPU 120*a* performs demo performance pattern determination processing to determine a demo performance pattern.

Specifically, the sub CPU 120*a* determines the demo performance pattern, and sets the determined demo performance pattern into the performance pattern storing area. To transmit the information on the determined demo performance pattern to the image control board 150 and the lamp control board 140, the sub CPU 120*a* further sets a performance pattern specification command based on the determined demo performance pattern into the transmission buffer of the sub RAM 120*c*.

At step S1620, the sub CPU 120*a* checks whether the command stored in the reception buffer is a special symbol storing specification command.

If the command stored in the reception buffer is a special symbol storing specification command, the sub CPU 120*a* shifts the processing to step S1621. If not a special symbol storing specification command, the sub CPU 120*a* shifts the processing to step S1630.

At step S1621, the sub CPU 120*a* performs special symbol stored number determination processing. In the processing, the sub CPU 120*a* analyzes the special symbol storing specification command to determine the number of special symbol reservation images for the liquid crystal display 31 to display, and transmits a special symbol display number specification command corresponding to the determined number of special symbol reservation images to display to the image control board 150 and the lamp control board 140.

At step S1630, the sub CPU 120*a* checks whether the command stored in the reception buffer is a performance symbol specification command.

If the command stored in the reception buffer is a performance symbol specification command, the sub CPU 120*a* shifts the processing to step S1631. If not a performance symbol specification command, the sub CPU 120*a* shifts the processing to step S1640.

At step S1631, the sub CPU 120*a* performs performance symbol determination processing to determine the performance symbol 36 to be stopped and displayed on the liquid crystal display 31 based on the content of the performance symbol specification command received.

Specifically, the sub CPU 120*a* analyzes the performance symbol specification command to determine performance symbol data that constitutes a combination of performance symbols 36 depending on the presence or absence of a jackpot and the type of the jackpot. The sub CPU 120*a* sets the determined performance symbol data into the performance symbol storing area. To transmit the performance symbol data to the image control board 150 and the lamp control board 140, the sub CPU 120*a* also sets a stop symbol specification command that indicates the performance symbol data into the transmission buffer of the sub RAM 120*c*.

At step S1632, the sub CPU 120*a* performs performance mode determination processing. In the processing, the sub CPU 120*a* acquires a random number value from the performance mode determination random number values updated in the foregoing step S1100, and determines a performance mode from among a plurality of performance modes (such as normal performance mode and chance performance mode) based on the performance mode determination random number value acquired and the performance symbol specification command received. The determined performance mode is set into the performance mode storing area.

At step S1640, the sub CPU 120*a* checks whether the command stored in the reception buffer is a variation pattern specification command.

If the command stored in the reception buffer is a variation pattern specification command, the sub CPU 120*a* shifts the processing to step S1641. If not a variation pattern specification command, the sub CPU 120*a* shifts the processing to step S1650.

At step S1641, the sub CPU 120*a* performs variation performance pattern determination processing. In the processing, the sub CPU 120*a* acquires a random number value from the performance random number values 1 updated in the foregoing step S1100, and determines a variation performance pattern from among a plurality of variation performance patterns based on the performance random number value 1 acquired, the variation pattern specification command received, and the performance mode set in the performance mode storing area.

Subsequently, the liquid crystal display 31, the sound output devices 32, the performance drive device 33, and the performance illumination devices 34 are controlled based on the performance pattern.

It should be noted that the variation mode of the performance symbols 36 is determined based on the variation performance pattern determined here.

At step S1650, the sub CPU 120*a* checks whether the command stored in the reception buffer is a symbol fix command.

If the command stored in the reception buffer is a symbol fix command, the sub CPU 120*a* shifts the processing to step S1651. If not a symbol fix command, the sub CPU 120*a* shifts the processing to step S1660.

At step S1651, the sub CPU 120*a* performs performance symbol stop display processing. In the processing, the sub CPU 120*a* sets a stop specification command for displaying without variations a performance symbol into the transmission buffer of the sub RAM 120*c* in order to stop and display a performance symbol 36.

At step S1660, the sub CPU 120*a* judges whether the command stored in the reception buffer is a game state specification command.

If the command stored in the reception buffer is a game state specification command, the sub CPU 120*a* shifts the processing to step S1661. If not a game state specification command, the sub CPU 120*a* shifts the processing to step S1670.

At step S1661, the sub CPU 120*a* sets data that indicates the game state based on the received game state specification command, into the game state storing area of the sub RAM 120*c*.

At step S1670, the sub CPU 120*a* checks whether the command stored in the reception buffer is an opening command.

If the command stored in the reception buffer is an opening command, the sub CPU 120*a* shifts the processing to step S1671. If not an opening command, the sub CPU 120*a* shifts the processing to step S1680.

At step S1671, the sub CPU 120*a* performs winning start performance pattern determination processing to determine a winning start performance pattern.

Specifically, the sub CPU 120*a* determines the winning start performance pattern based on the opening command, and sets the determined winning start performance pattern into the performance pattern storing area. To transmit the information on the determined winning start performance pattern to the image control board 150 and the lamp control board 140, the sub CPU 120*a* further sets a performance pattern specification command based on the determined winning start performance pattern into the transmission buffer of the sub RAM 120*c*.

At step S1680, the sub CPU 120*a* checks whether the command stored in the reception buffer is a bonus prize hole open specification command.

If the command stored in the reception buffer is a bonus prize hole open specification command, the sub CPU 120*a* shifts the processing to step S1681. If not a bonus prize hole open specification command, the sub CPU 120*a* shifts the processing to step S1690.

At step S1681, the sub CPU 120*a* performs jackpot performance pattern determination processing to determine a jackpot performance pattern.

Specifically, the sub CPU 120*a* determines the jackpot performance pattern based on the bonus prize hole open specification command, and sets the determined jackpot performance pattern into the performance pattern storing area. To transmit the information on the determined jackpot performance pattern to the image control board 150 and the lamp control board 140, the sub CPU 120*a* further sets a performance pattern specification command based on the determined jackpot performance pattern into the transmission buffer of the sub RAM 120*c*.

At step S1690, the sub CPU 120*a* determines whether the command stored in the reception buffer is an ending command.

If the command stored in the reception buffer is the ending command, the sub CPU 120*a* shifts the processing to step S1691. If not an ending command, the sub CPU 120*a* ends the command analysis processing.

At step S1691, the sub CPU 120*a* performs winning end performance pattern determination processing to determine a winning end performance pattern.

Figure 17:
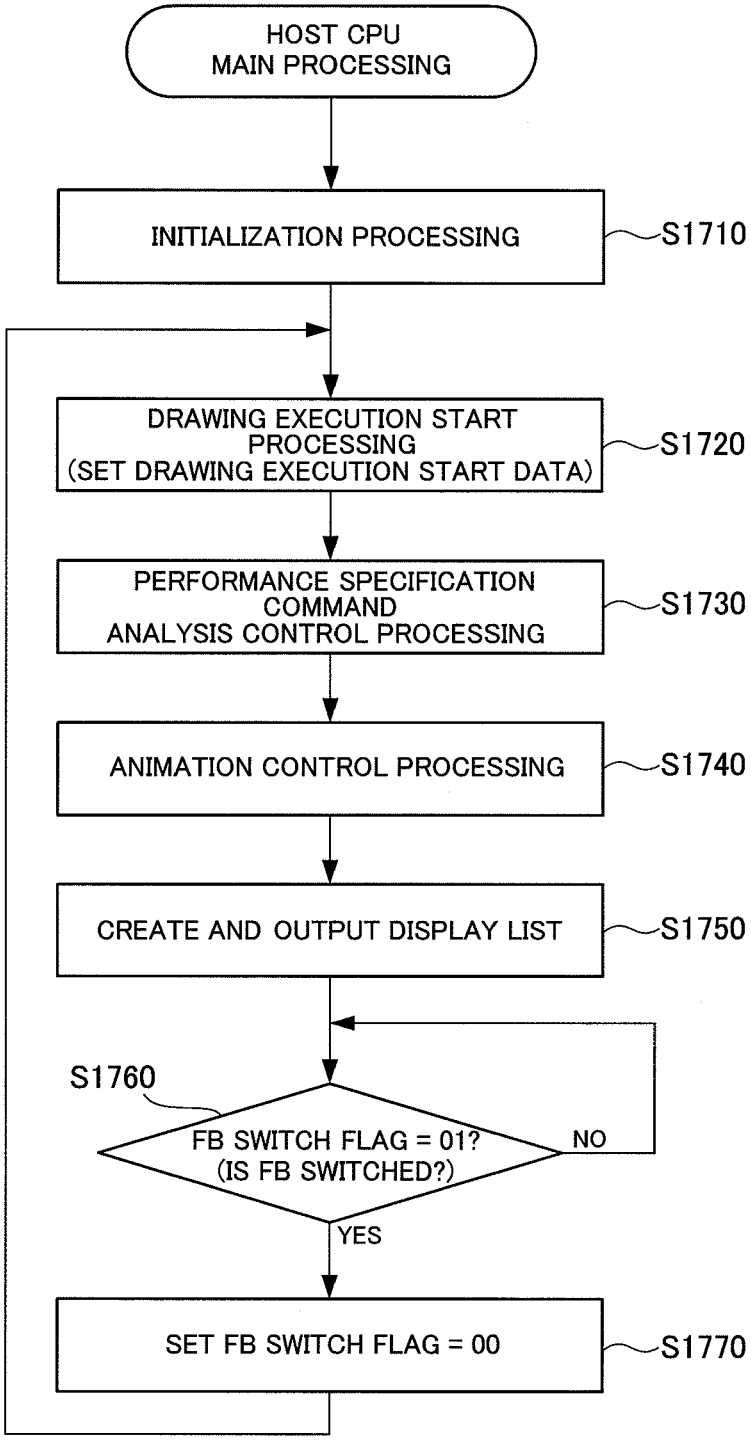
FIG. 17 is a flowchart showing the detailed procedure of main processing of the image control board 150.

Specifically, the sub CPU 120*a* determines the winning end performance pattern based on the ending command, and sets the determined winning end performance pattern into the performance pattern storing area. To transmit the information on the determined winning end performance pattern to the image control board 150 and the lamp control board 140, the sub CPU 120*a* further sets a performance pattern specification command based on the determined winning end performance pattern into the transmission buffer of the sub RAM 120*c*. After the completion of the processing, the command analysis processing ends. Referring to FIG. 17, the main processing of the image control board 150 will be described.

When power is supplied from the power supply board 170, system reset occurs in the host CPU 150*a*. The host CPU 150*a* performs the following main processing.

At step S1710, the host CPU 150*a* performs initialization processing. In the processing, the host CPU 150*a* loads a main processing program from the host ROM 150*c* in response to the power-on, and gives instructions for the initial setting of various modules of the host CPU 150*a* and the VDP 2000.

For the initial setting of the VDP 2000, the host CPU 150*a* performs following steps.

(1) Giving an instruction to generate a video signal (set 1 into the zeroth bit of the display register) in order to instruct the display circuit to create and output a video signal.

(2) Setting predetermined initial value data into the decompression register in order to make the decompression circuit decompress and expand frequently-used image data (such as image data on the performance symbols 36) into the expansion storing area 153*b* of the VRAM 153.

(3) Outputting an initial value display list in order to make the drawing circuit draw initial value image data (such as a text image "Starting up").

At step S1720, the host CPU 150*a* performs drawing execution start processing. In the processing, the host CPU 150*a* sets drawing execution start data into the drawing register in order to instruct the VDP 2000 to execute drawing based on the previously-output display list.

More specifically, on startup, the VDP 2000 is instructed to execute drawing based on the initial value display list that is output in the foregoing step S1710. In normal routine processing, the VDP 2000 is instructed to execute drawing based on a display list that is output at S1750 to be described later.

At step S1730, the host CPU 150*a* performs performance instruction command analysis processing to analyze a performance instruction command transmitted from the performance control board 120 (command stored in a reception buffer of the host RAM 150*b*).

When the image control board 150 receives a command transmitted from the performance control board 120, not-shown command reception interrupt processing occurs in the image control board 150, whereby the received command is stored into the reception buffer. Subsequently, the processing of analyzing the received command is performed in this step S1730.

The performance instruction command analysis processing determines whether a performance instruction command is stored in the reception buffer. If there is no performance instruction command stored in the reception buffer, the host CPU 150*a* simply shifts the processing to step S1740.

If a performance instruction command is stored in the reception buffer, the host CPU 150*a* reads the new performance instruction command. Based on the loaded performance instruction command, the host CPU 150*a* determines one or a plurality of animation groups to perform, and determines an animation pattern from each animation group. After the determination of the animation pattern(s), the host CPU 150*a* erases the loaded performance instruction command.

At step S1740, the host CPU 150*a* performs animation control processing. In the processing, the host CPU 150*a* updates the addresses of various animation scenes based on a scene "switch counter", the "wait frame", and a "frame counter" which are updated in step S2210 to be described later, and the animation pattern(s) determined in the foregoing step S1730.

At step S1750, the host CPU 150*a* generates a display list from single-frame display information (sprite ID number, display position, and the like) on the animation scenes at the updated addresses, depending on the priority (order of drawing) of the animation groups to which the animation scenes belong.

After the generation of the display list is completed, the host CPU 150*a* outputs the display list to the VDP 2000.

The display list output here is stored into the display list storing area 153*a* of the VRAM 153 through the CPU I/F of the VDP 2000.

At step S1760, the host CPU 150*a* determines whether "FB switch flag=01" or not.

The "FB switch flag=01" holds if the drawing of the previous display list has been completed by a V blank interrupt which occurs at intervals of 1/60 sec (approximately 16.6 ms). That is, at step S1760, the host CPU 150*a* determines whether the previous drawing has been completed.

If "FB switch flag=01", the host CPU 150*a* shifts the processing to step S1770. If "FB switch flag=00", the host CPU 150*a* waits until "FB switch flag=01".

At step S1770, the host CPU 150*a* sets "FB switch flag=00" (resets the FB switch flag "off"), and shifts the processing to step S1720.

Subsequently, the host CPU 150*a* repeats the processing of steps S1720 to S1770 until a predetermined interrupt occurs.

Figure 18:
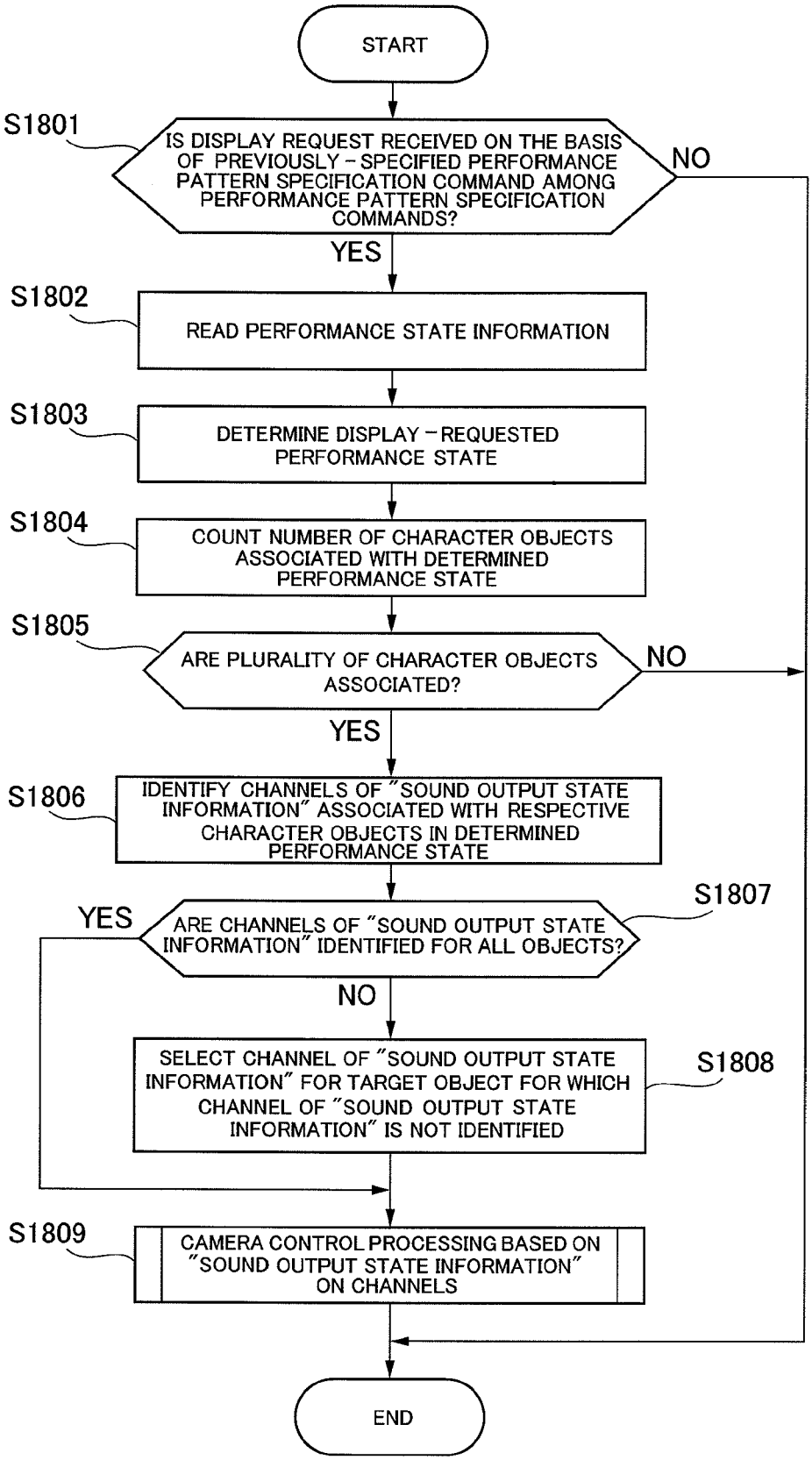
FIG. 18 is a flowchart showing the detailed procedure of processing performed in the performance control unit which constitutes the game machine according to the embodiment of the present invention.

FIG. 18 is a flowchart showing the detailed procedure of processing to be performed in the performance control unit 200 which constitutes the game machine according to the embodiment of the present invention.

In FIG. 18, the processing is started when the performance control unit 200 which constitutes the host CPU 150*a* of the image control board 150 receives a display request based on data for executing a predetermined performance (performance pattern specification command) from the performance control board 120 which controls each individual performance during a game, on standby, and the like.

The performance control unit 200 initially decides whether the display request received is one in a performance using a performance image that is mapped by arranging three-dimensional objects in the three-dimensional virtual space and imaging the three-dimensional objects with the virtual camera (S1801). If the display request received is other than such a display request (NO at S1801), the host CPU 150*a* performs processing to display a performance image based on the display request received.

If the display request received is for a performance image that is mapped by imaging three-dimensional objects with the virtual camera (YES at S1801), the performance control unit 200 reads performance state information such as shown in FIG. 20 (S1802). The performance state information specifies the target objects to be mapped by the virtual camera in a predetermined performance state, and specifies the channels of the sound output state information which indicate the output states of sound information to be output for the respective target objects.

Next, the performance control unit 200 determines the state of the performance (performance state) to display performance images based on the received display request (S1803). The performance control unit 200 then identifies the objects specified in the determined performance state from the loaded performance state information, and counts the number of target objects identified (S1804).

The performance control unit 200 decides if the number of target objects counted is more than one (S1805). If a plurality of target objects are not specified in the determined performance state (NO at S1805), the performance control unit 200 ends the processing of this flowchart.

On the other hand, if a plurality of target objects are specified in the determined performance state (YES at S1805), the performance control unit 200 then identifies the channels of the sound output state information for the respective target objects (S1806). The performance control unit 200 decides whether the channels of the sound output state information are identified for all the target objects (S1807). If the channels are not identified for all the target objects (NO at S1807), the performance control unit 200 selects a channel of the "sound output state information" for the target object for which no channel of the "sound output state information" is identified (S1808).

FIGS. 21A and 21B show an example of the "sound output state information" on such channels.

If the channels are specified for all the target objects (S1808, YES at S1807), the performance control unit 200 performs camera control processing on the virtual camera based on the "sound output state information" on the channels specified for the respective target objects (S1809).

Figure 19:
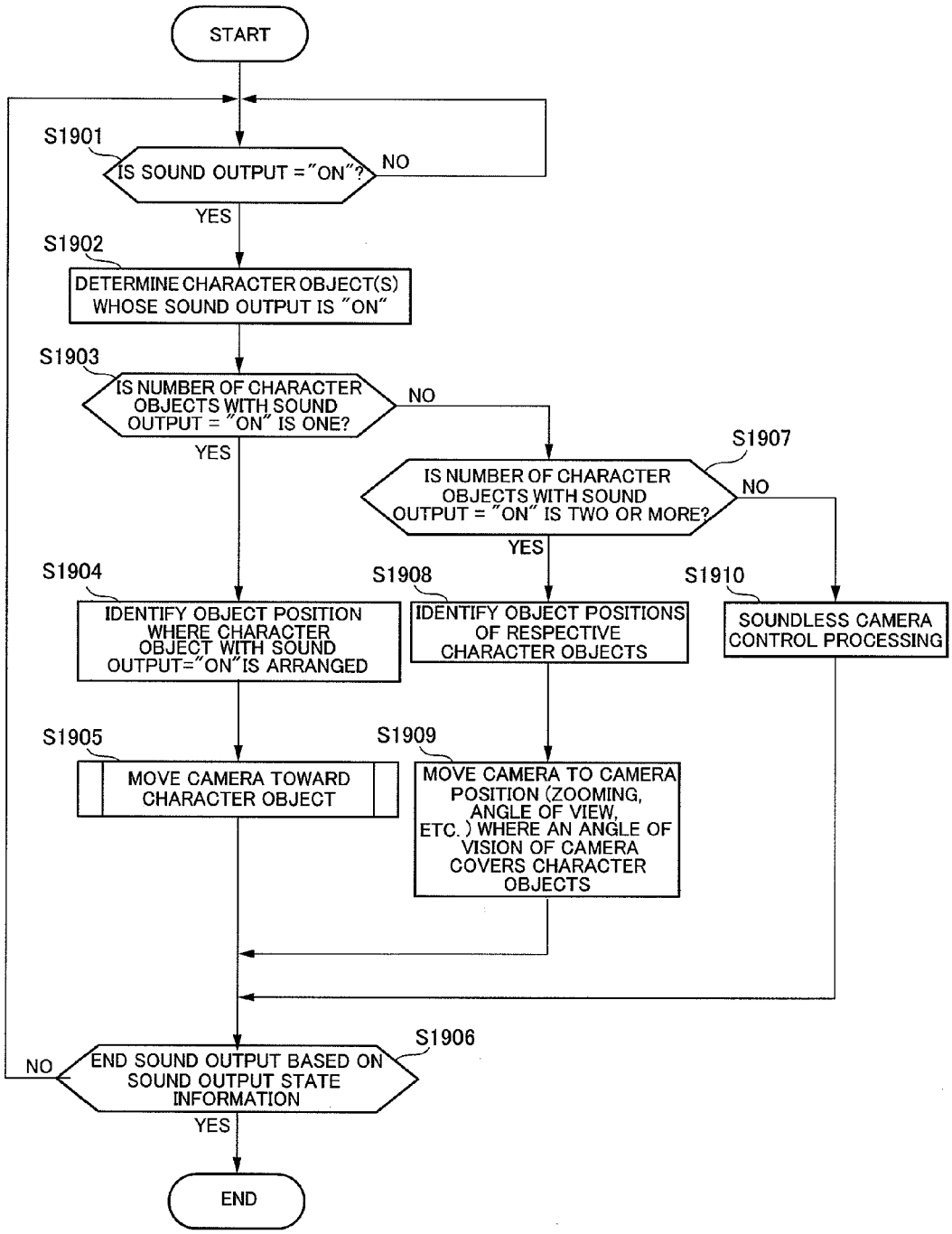
FIG. 19 is a flowchart showing the detailed procedure of camera control processing which is included in the flowchart of FIG. 18.

The detailed procedure of the camera control processing will be shown in FIG. 19.

FIG. 19 is a flowchart showing the detailed procedure of the camera control processing which is included in the flowchart of FIG. 18.

In FIG. 19, the clocking of the elapsed time is started, and the performance control unit 200 decides whether a sound output is being performed (sound output "ON" state) based on the sound output state information (S1901). If a sound output is "ON" at predetermined timing of the sound output state information (YES at S1901), the performance control unit 200 determines the target object whose sound output is "ON" (S1902).

The performance control unit 200 decides whether the number of target objects whose sound output is "ON" is one (S1903). If the number of target objects with sound output "ON" is one (YES at S1903), the performance control unit 200 identifies the object position where the target object is arranged (S1904). The performance control unit 200 then performs motion processing to direct the camera toward the target object (S1905).

On the other hand, if the number of target objects with sound output "ON" is not just one (NO at S1903), the performance control unit 200 decides whether a plurality of target objects simultaneously perform a sound output (S1907). If a plurality of target objects simultaneously perform a sound output (YES at S1907), the performance control unit 200 identifies the object positions of the target objects (S1908).

Having identified the object positions of the respective plurality of target objects, the performance control unit 200 moves the camera to a camera position (the angle of view, zooming) where an angle of vision of the camera covers the target objects (S1909).

If the number of target objects with sound output "ON" is not one and a plurality of target object do not simultaneously perform a sound output (NO at S1907), the performance control unit 200 performs soundless camera control processing (S1910). The soundless camera control processing is to image the three-dimensional objects from a predetermined camera position.

The performance control unit 200 then decides from the clocking of the elapsed time whether the sound output based on the sound output state information is ended (S1906). If the sound output based on the sound output state information is ended (YES at S1906), the performance control unit 200 ends the processing of this flowchart.

If the sound output based on the sound output state information is not ended (NO at S1906), the performance control unit 200 returns to the processing of deciding whether a sound output is being performed (sound output "ON" state) based on the sound output state information (S1901).

Figure 22:
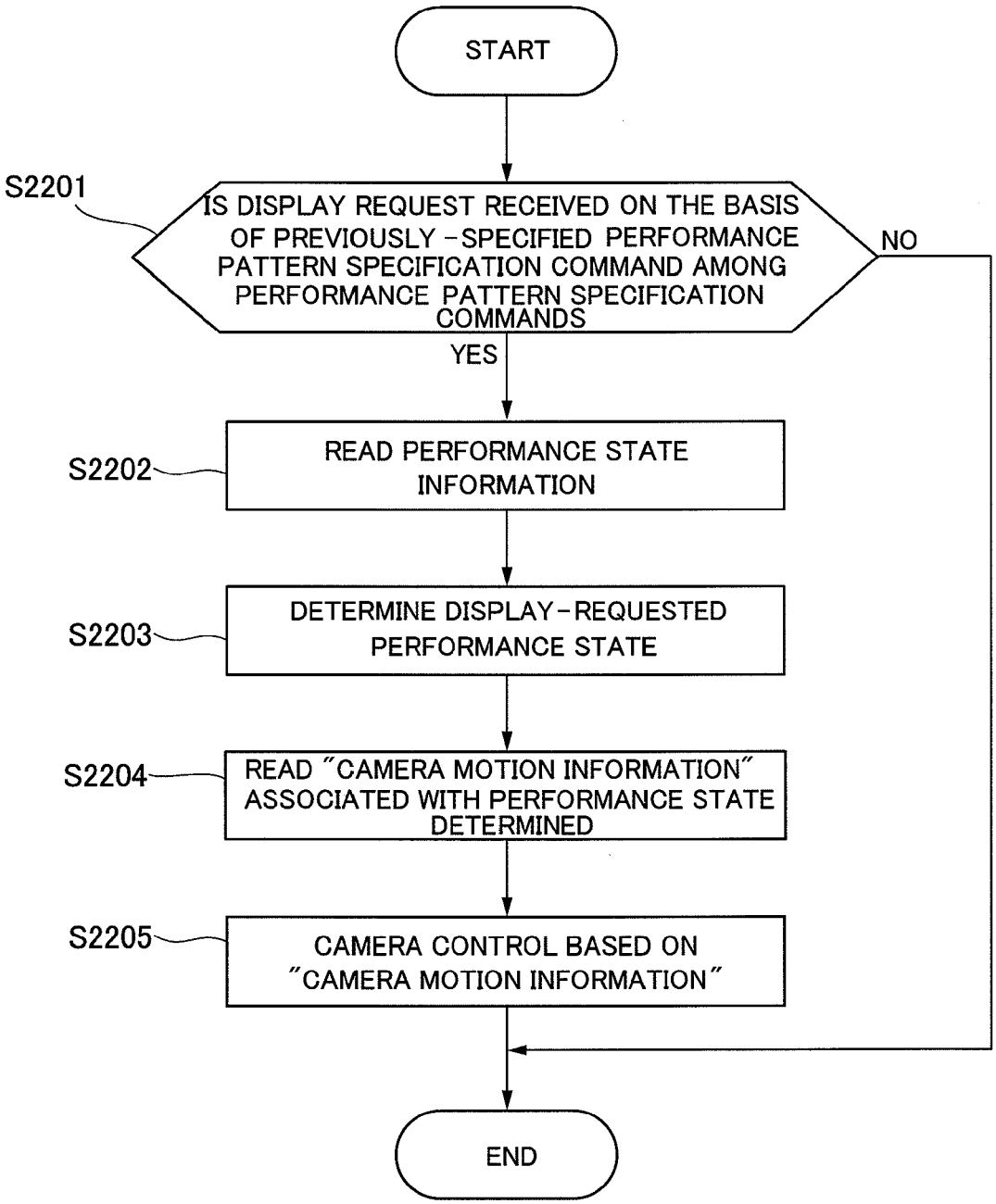
FIG. 22 is a flowchart showing the detailed procedure of processing performed in the performance control unit which constitutes the game machine according to the embodiment of the present invention.

FIG. 22 is a flowchart showing the detailed procedure of processing to be performed in the performance control unit 200 which constitutes the game machine according to the embodiment of the present invention.

FIG. 22 is similar to FIG. 18. In FIG. 22, the processing is started when the performance control unit 200 which constitutes the host CPU 150*a* of the image control board 150 receives a display request based on data for performing a predetermined performance (performance pattern specification command) from the performance control board 120 which controls each individual performance during a game, on standby, and the like.

The performance control unit 200 initially decides whether the received display request is one in a performance using a performance image that is mapped by arranging three-dimensional objects in the three-dimensional virtual space and imaging the three-dimensional objects with the virtual camera (S2201). If the display request received is other than such a display request (NO at S2201), the host CPU 150*a* performs processing to display a performance image based on the received display request.

If the received display request is for a performance image that is mapped by imaging three-dimensional objects with the virtual camera (YES at S2201), the performance control unit 200 reads performance state information such as shown in FIG. 20 (S2202). The performance state information specifies the target objects to be mapped by the virtual camera in a predetermined performance state, and specifies the channels of the sound output state information which indicate the output states of sound information to be output for the respective target objects.

Next, the performance control unit 200 determines the state of the performance (performance state) to display performance images based on the display request received (S2203).

Having determined the performance state, the performance control unit 200 reads performance state information such as shown in FIG. 23 (S2204). The performance state information identifies the target objects to be subjected to the camera control of the virtual camera in the determined performance state, and identifies camera motion information that describes the state of operation of the camera.

Using the loaded performance state information, the performance control unit 200 then performs camera control based on the camera motion information specified for the determined performance state (S2205).

The embodiment described above is only one embodiment of the present invention. The present invention is not limited to such embodiments, and modifications may be made as appropriate without changing the gist of the invention.

The present invention may also provide a computer that performs the foregoing processing by installing programs for implementing the foregoing means in the computer from a recording medium (such as CD-ROM and DVD-ROM) storing the programs, and executing the same. Such a computer includes a CPU (Central Processing Unit), a ROM (Read Only Memory), a RAM (Random Access Memory), and a hard disk which are connected through a system bus. The CPU performs processing according to the programs stored in the ROM or the hard disk, using the RAM as the work areas.

The medium for supplying the programs may be a communication medium (a medium that temporarily or fluidly retains the programs, such as a communication line and a communication system). For example, the programs may be posted to a BBS (Bulletin Board Service) of a communication network and distributed through communication lines.

What is claimed is:

1. A game machine, comprising:

a display device configured to display a performance image drawn by mapping a performance object arranged in a three-dimensional virtual space from a virtual camera which serves as a viewpoint in the three-dimensional virtual space;

a sound output device configured to output sound information in a performance using the performance object;

a storing device configured to store state information on a sound output state of each performance object with respect to a performance time of the object;

a sound output performance object identifying device configured to identify a performance object of which the sound information is output, based on the state information stored by the storing device;

a camera motion information generating device configured to generate camera motion information for determining a state of operation of the virtual camera, according to sound output state information on the performance object identified by the sound output performance object identifying device in a game using a game medium;

a camera direction changing device configured to change a direction of the virtual camera toward a performance object in accordance with the camera motion information generated by the camera motion information generating device;

a mapping device configured to map the performance object from a camera position of the virtual camera after changing the direction of the camera by the camera direction changing device;

a drawing device configured to draw a performance image that includes the performance object mapped by the mapping device; and a display control device configured to display and control the performance image drawn by the drawing device on the display device, wherein the mapping device maps the performance object by changing the direction of the virtual camera toward the performance object corresponding to the sound output state indicated by the sounds out state information from which the camera motion information is generated.

2. The game machine according to claim 1, wherein:

the mapping device includes a camera switching device configured to switch to another virtual camera different from the virtual camera with which the performance object of which the sound information is output from the sound output device is mapped; and the performance object is mapped from the viewpoint of the virtual camera after being switched by the camera switching device.

3. The game machine according to claim 1, wherein:

the mapping device maps only the performance object of which the sound output is performed by the sound output device based on the sound information; and the drawing device draws the performance image that includes no performance object other than the performance object mapped by the mapping device.

4. The game machine according to claim 1, wherein if a plurality of performance objects are identified by the sound output performance object identifying device, the mapping device maps so as to cover the performance objects.

5. A display control method, comprising:

mapping, by a mapping device, a performance object of which sound information is output from a sound output device with a virtual camera, the sound output device outputting sound information in a performance using a performance object arranged in a three-dimensional virtual space in a game using a game medium;

storing, by a storing device, state information on a sound output state of each performance object with respect to a performance time of the object;

identifying a performance object of which the sound information is output, based on the state information stored by the storing device;

generating camera motion information for determining a state of operation of the virtual camera, according to sound output state information on the performance object;

changing a direction of the virtual camera toward a performance object in accordance with the camera motion information;

drawing a performance image that includes the mapped performance object; and displaying and controlling the drawn performance image on a display device, wherein the mapping device maps the performance object by changing the direction of the virtual camera toward the performance object corresponding to the sound output state indicated by the sound output state information from which the camera motion information is generated.

6. A non-transitory digital storage medium having stored thereon a computer program with a program code for performing, when the program is executed on a computer, a display control program method comprising:

mapping, by a mapping device, a performance object of which sound information is output from a sound output device with a virtual camera, the sound output device outputting sound information in a performance using a performance object arranged in a three-dimensional virtual space in a game using a game medium;

storing, by a storing device, state information on a sound output state of each performance object with respect to a performance time of the object;

identifying a performance object of which the sound information is output, based on the state information stored by the storing device;

generating camera motion information for determining a state of operation of the virtual camera, according to sound output state information on the performance object;

changing a direction of the virtual camera toward a performance object in accordance with the camera motion information;

drawing, by a drawing device, a performance image that includes the performance object mapped by the mapping device; and displaying and controlling, by a display control device, the performance image drawn by the drawing device on a display device, wherein the mapping device maps the performance object by changing the direction of the virtual camera toward the performance object corresponding to the sound output state indicated by the sound output state information from which the camera motion information is generated.

* * * * *